United States Patent [19]

Kuroda et al.

[11] Patent Number: 4,526,698

[45] Date of Patent: Jul. 2, 1985

[54] BLEACHING DETERGENT COMPOSITION COMPRISES COATED SODIUM PERCARBONATE PARTICLES

[75] Inventors: Muthmi Kuroda, Funabashi; Moriyasu Murata, Chiba; Tsunesi Takeda; Junich Tamura, both of Wakayama, all of Japan

[73] Assignee: Kao Corporation, Tokyo, Japan

[21] Appl. No.: 502,053

[22] Filed: Jun. 7, 1983

[30] Foreign Application Priority Data

Jun. 10, 1982 [JP] Japan ..... 57-99826

[51] Int. Cl.[3] ..... C11D 7/04; C11D 3/395; C11D 7/54

[52] U.S. Cl. ..... 252/99; 252/91; 252/95; 252/135; 252/174.13; 252/174.14; 252/186.27; 252/186.3

[58] Field of Search ..... 252/186.27, 95, 91, 252/174.13, 174.14, 99, 135, 186.3

[56] References Cited

U.S. PATENT DOCUMENTS

| | | | |
|---|---|---|---|
| 2,254,434 | 9/1941 | Dusseldorf | 252/186.27 |
| 3,664,961 | 5/1972 | Norris | 252/95 X |
| 3,979,318 | 9/1976 | Tokiwa et al. | 252/95 X |
| 4,071,462 | 1/1978 | Matsunaga et al. | 252/95 X |
| 4,179,394 | 12/1979 | Dilenburg et al. | 252/95 |
| 4,219,435 | 8/1980 | Biard et al. | 252/135 |
| 4,325,933 | 4/1982 | Matsumoto et al. | 252/186.27 X |
| 4,374,747 | 2/1983 | Tai | 252/186.27 X |

OTHER PUBLICATIONS

C.A. 70369j, Bleaching Cleaner, vol. 100, 1984.

*Primary Examiner*—John E. Kittle
*Assistant Examiner*—Mukund J. Shah
*Attorney, Agent, or Firm*—Flynn, Thiel, Boutell & Tanis

[57] ABSTRACT

A bleaching detergent composition contains as effective component sodium percarbonate which has been coated with a coating agent containing a borate.

21 Claims, 3 Drawing Figures

BLEACHING DETERGENT COMPOSITION COMPRISES COATED SODIUM PERCARBONATE PARTICLES

The present invention relates to a bleaching detergent having an excellent storage stability. More particularly, the present invention relates to a bleaching detergent containing sodium percarbonate surface coated with a borate-containing coating agent.

Sodium percarbonate has been known as a bleaching agent or oxidizing agent. Like sodium perborate, sodium percarbonate is a typical oxygen-containing bleaching agent. Generally, sodium percarbonate is produced by reacting sodium carbonate with hydrogen peroxide and is represented by the formula:

$$2Na_2CO_3.3H_2O_2.$$

Sodium percarbonate has a bleaching power slightly lower than that of chlorine-containing bleaching agents at ambient temperature. However, it has advantages that it does not yellow synthetic fibers, animal fibers, resin-treated fibers or fibers treated with fluorescent brightening agents and it does not damage the fibers. Further, it exhibits sufficient bleaching effects at an elevated temperature or in the presence of a decomposition accelerator. Therefore, sodium percarbonate has been used as a domestic or commercial bleaching agent.

Reasons why sodium percarbonate has attracted attention in the field of general detergents and domestic bleaching agents are that its decomposition products do not cause environmental pollution and that it can be used practically in any manner without posing any problem.

However, sodium percarbonate has a fatal defect that its storage stability is far inferior to that of sodium perborate and available oxygen is lost rapidly during the storage. Surface of sodium percarbonate becomes wet and is decomposed in the presence of even a very low moisture, since it has a high affinity with water. Particularly when iron, copper, manganese or cobalt ion is contained therein, the decomposition is further accelerated and the stability thereof is lower than that of sodium perborate. When sodium percarbonate is stored alone in a closed vessel, its storage stability is equal to that of sodium perborate. However, when sodium percarbonate is stored in the form of a mixture with a detergent or in an open vessel, it exhibits a high hygroscopicity and low storage stability, though it has a high solubility.

Sodium tripolyphosphate (STPP) contained as a builder in detergents invites eutrophication to cause environmental pollution in a closed water area. Under these circumstances, the demand of low-phosphorus or phosphorus-free detergents has been increased. In the production of the low-phosphorus or phosphorus-free detergents, synthetic zeolites (aluminosilicates) have become into wide use recently as a substitute for STPP.

However, sodium percarbonate is quite unstable in the zeolite-containing detergent. In the zeolite-containing, phosphorus-free detergent, available oxygen of sodium percarbonate is lost rapidly by the catalytic decomposition due to the zeolite.

Therefore, a technique has eagerly been demanded for reducing the phosphorus content of the detergent or dispensing with STPP and attaining a high storage stability of sodium percarbonate contained therein.

There have been proposed processes for stabilizing sodium percarbonate, such as one wherein sodium percarbonate is coated with paraffin or one wherein it is coated with polyethylene glycol having a molecular weight of 3000 to 8000. However, in the former process, the water solubility is reduced seriously and impractically. In the latter process, the long-term storage stability cannot be obtained, since polyethylene glycol per se has a considerable hygroscopicity, though the water solubility is not deteriorated.

Another process has been proposed wherein at least two stabilizers selected from the group consisting of phosphoric acid compounds, silicic acid compounds, ethylenediaminetetraacetates and nitrilotriacetates are incorporated in an aqueous hydrogen peroxide solution in the production of sodium percarbonate. However, these stabilizers do not exhibit any practical stabilization effect when they are mixed with water or detergents, though they exhibit a stabilizing effect against temperature. In still another process, sodium percarbonate is uniformly coated with sodium pyrophosphate. However, this process is not satisfactory with respect to the stabilizing effect in the presence of water and detergents, though the thermal decomposition rate is low.

An object of the present invention is to provide a bleaching detergent containing sodium percarbonate which can be stored stably until use even when sodium percarbonate is incorporated into a low-phosphorus or phosphorus-free detergent.

After intensive investigations made for attaining the object, the inventors have found that the object can be attained by coating sodium percarbonate contained in a bleaching detergent with a borate-containing coating agent. The present invention has been attained on the basis of this finding.

The invention provides a new composition suitable for a bleaching detergent and a bleaching agent. The composition is characterized by containing therein 1 to 99 percent by weight of sodium percarbonate coated on the surface with a borate-containing coating agent. The bleaching detergent composition preferably comprises 1 to 40 percent by weight of said coated sodium percarbonate. The bleaching composition preferably comprises 40 to 99 percent by weight of said coated sodium percarbonate.

Figure 1:
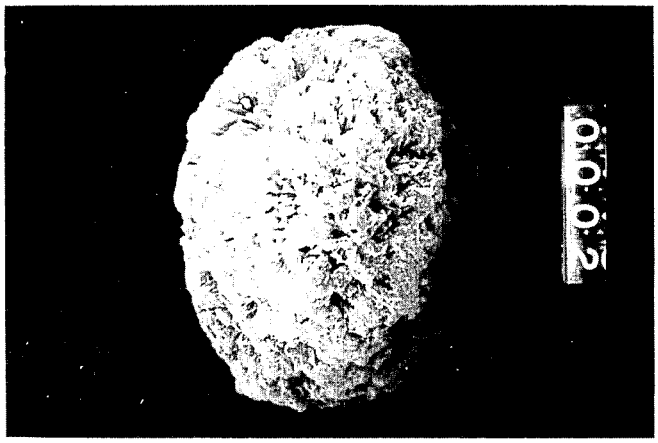
FIG. 1 is a scanning electron microscope photograph of uncoated sodium percarbonate particles.
Figure 2:
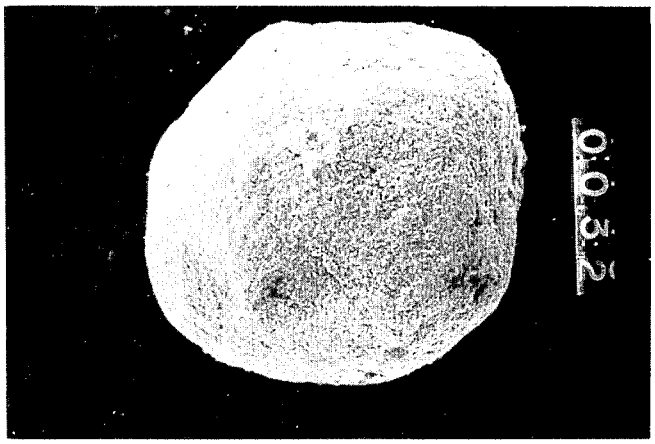
FIG. 2 is a scanning electron microscope photograph of coated sodium percarbonate particles, each at 100× magnification.
Figure 3:
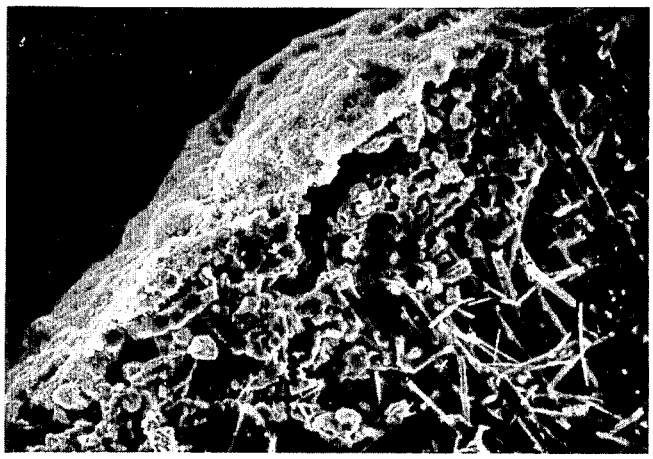
FIG. 3 is an enlarged (440× magnification, photograph of a cross section of the coated sodium percarbonate particles of FIG. 2, and shows a borate-coating layer on the surfaces of the particles. The sodium carbonate of FIGS. 2 and 3 is coated with 3.7% of sodium metaborate dihydrate.

The percarbonate contained in the bleaching detergent according to the present invention is stabilized by coating the same with a coating agent containing a borate, preferably sodium borate, particularly sodium metaborate. The coating agent may further contain a sequestering agent such as ethylenediaminetetraacetate, nitrilotriacetate or phosphate.

The amount of the coating agent is preferably 0.1 to 30 wt.% based on sodium percarbonate. The amount of the borate in the coating agent is preferably 10 to 100 wt.%.

It is known that boric acid compounds can be used as coating/graulating agents for peroxides to be incorporated in bleaching detergents. For example, boric acid compounds (orthoboric, metaboric or tetraboric acid) are disclosed as coating agents for peroxides in the specification of British Pat. No. 1,575,792. In the specification of Japanese Patent Publication No. 6760/1974, it is disclosed to add metaboric acid to a hydrogen peroxide adduct to improve its storage stability. However, these publications are silent on the coating of peroxides with the borates as in the process of the present invention.

The inventors have found that the borate coating has a high spreadability, its sodium percarbonate-coating efficiency is quite high, and that powdery or granular sodium percarbonate surface coated with the borate has a storage stability far higher than that of sodium percarbonate coated with boric acid in a bleaching detergent. The present invention has been attained on the basis of this finding. Electron photomicrographs show that the surfaces of sodium percarbonate particles are uniformly coated with the borate. This fact proves that the coating process of the present invention is highly efficient.

As the borates used for coating sodium percarbonate according to the present invention, sodium borates are suitable. They include sodium tetraborate decahydrate (borax, $Na_2O.2B_2O_3.10H_2O$), sodium tetraborate pentahydrate ($Na_2O.2B_2O_3.5H_2O$), sodium tetraborate tetrahydrate ($Na_2O.2B_2O_3.4H_2O$), (anhydrous) sodium tetraborate ($Na_2O.2B_2O_3$), sodium octaborate tetrahydrate ($Na_2O.4B_2O_3.4H_2O$), sodium pentaborate pentahydrate ($Na_2O.5B_2O_3.10H_2O$), sodium metaborate tetrahydrate ($NaBO_2.4H_2O$) and sodium metaborate dihydrate ($NaBO_2.2H_2O$). Among them, sodium metaborate dihydrate and sodium metaborate tetrahydrate are particularly preferred.

The coating agent for sodium percarbonate used in the present invention may contain various organic or inorganic compounds in combination with the sodium borates. The inorganic compounds are, for example, sodium carbonate, Glauber's salt and magnesium sulfate. The organic compounds are, for example, organic high molecular compounds such as polyethylene glycol, polyvinylpyrrolidone and hydroxypropylcellulose. The sodium borates may also be used in combination with a sequestering agent such as a nitrilotriacetate or ethylenediaminetetraacetate. The amount of the sequestering agent is preferably 0.01 to 3 wt.% based on sodium percarbonate.

Sodium percarbonate may be coated with the coating agent containing the borate by an ordinary coating method in the present invention. For example, a solution of the coating agent or a powdery coating agent is mixed with wet or dry sodium percarbonate powder or granules to effect uniform adsorption and the mixture is dried. The coated sodium percarbonate particles have an average particle diameter of 100 to 2000$\mu$, preferably 250 to 1000$\mu$.

The inventors have made studies to find a process for the preparation of a borate-coated sodium percarbonate which can be practiced industrially easily and makes it possible to completely coat sodium percarbonate with a borate. As a result, we have found that the desired sodium percarbonate can be obtained by utilizing the characteristics of the borate in the coating treatment.

The most advantageous method for obtaining a surface-coated sodium percarbonate by treating its powder with a coating agent containing a borate according to the present invention comprises wetting sodium percarbonate with water, mixing the wetted sodium percarbonate with a powdered coating agent containing a borate to make said agent be adsorbed by sodium percarbonate, and then drying at a temperature not lower than that at which the borate begins to melt.

In the above advantageous method of the present invention, it is believed that when a powdered borate containing water of crystallization is sprinkled on sodium percarbonate in a wetted state and then sodium percarbonate is dried at a temperature not lower than the melting point of the borate (for example, $Na_2B_4O_7.10H_2O$: 75° C., $NaBO_2.4H_2O$: 57° C., $NaBO_2.2H_2O$: 90° C. and $NaBO_3.4H_2O$: 63° C.), the borate is dissolved itself in the water of crystallization and becomes molten, and sodium percarbonate is completely enclosed in the molten borate.

During this stage, water in sodium percarbonate and water of crystallization in the borate are evaporated, and the drying operation is completed. Thus, uniform film formation and drying are simultaneously conducted. Usually, sodium percarbonate can be dried at a temperature ranging from 40° to 160° C. Drying can be effected even at a temperature below 40° C., but it takes too long a time to dry it. At a temperature above 160° C., sodium percarbonate undergoes ineffective decomposition and suffers a great loss of available oxygen. Thus it is preferred to conduct the drying at a temperature of not lower than the melting point of the borate, but not higher than 160° C. in the present invention.

Anhydrous borates have higher melting points than those of the corresponding hydrates (e.g., $Na_2B_4O_7$ melts at 741° C.), but the melting points of anhydrous borates are lowered because of the influence of moisture contained in the wetted sodium percarbonate which behaves just like water of crystallization. Hence the anhydrous borates can be used in the present invention, although borates containing water of crystallization are preferred. The amount of the borate in the borate-coated sodium percarbonate is 0.04 to 10% (W/W), preferably 0.1 to 5% (W/W) (in terms of boron) based on dry sodium percarbonate. The smaller particle size of the borate is preferred, but it is usually 50 to 300$\mu$, preferably 100 to 150$\mu$ from the viewpoint of workability.

As the wetted sodium percarbonate used for the production of the stable sodium percarbonate of the present invention, one obtained by reacting sodium carbonate with hydrogen peroxide in a conventional manner followed by dehydration in a conventional manner can be used as such. This percarbonate in a wetted state has a moisture content of 7 to 18%. Since the moisture serves as a necessary wetting water, the sodium percarbonate can be used as such. But, sodium percarbonate having a moisture content of 10 to 16% is preferred. When sodium percarbonate having a lower moisture content is used, it is preferred that sodium percarbonate is wetted with an appropriate amount of water so that a powdered borate can be uniformly sprinkled thereon.

It is advantageous that the coating agent of the present invention contains a conventional stabilizer for sodium percarbonate, such as an ethylenediaminetetraacetate, or a sequestering agent such as a nitrilotriacetate which does not have an adverse effect on the film formation of the molten borate.

In the preparation of the borate-coated sodium percarbonate of the present invention, sodium percarbonate may be coated by spraying an aqueous solution of a borate on sodium percarbonate powder, mixing said powder and then drying it. However, since dry sodium percarbonate must be used in this method, it is necessary to carry out the drying treatment twice.

Alternatively, sodium percarbonate may be coated by using sodium percarbonate powder wetted with water, particularly sodium percarbonate in a wetted state obtained by reacting hydrogen peroxide with sodium carbonate in an aqueous solution followed by dehydration, i.e. by mixing said sodium percarbonate in the wetted state with a powdered borate to make the borate be adsorbed by sodium percarbonate and then drying sodium percarbonate. This process utilizes the characteristics of the borate and is an industrially very advantageous process which can be easily conducted with less energy consumption without a necessity of dissolving the borate.

It is observed from the attached photomicrographs that in the borate-coated sodium percarbonate obtained by the process of the present invention, the surfaces of sodium percarbonate particles are uniformly coated with the borate.

The thus coated sodium percarbonate exhibits a quite high storage stability when it is incorporated in an ordinary powdery detergent (spray-dried detergent), particularly zeolite-containing low-phosphorus or phosphorus-free detergent. 1 to 40 wt.% of the obtained, coated sodium percarbonate is incorporated in a powdery detergent to obtain the intended bleaching detergent of the present invention.

As disclosed before, the invention provides an improved bleaching agent which contains 40 to 99 percent by weight of said coated sodium percarbonate. It solves the below mentioned problems in the state of the art.

However, sodium percarbonate has a drawback of being liable to be decomposed by moisture, heavy metal salts, or the like and hence is decomposed by absorption of moisture, other ingredients incorporated in the bleaching agent composition or impurities originating in a container during an prolonged storage. As a result, the amount of available oxygen is reduced. However, it is necessary, for sodium percarbonate for use in domestic bleaching agents, that it have a longterm storage stability, not absorb moisture after opening of the container, and not be affected by various formulation ingredients such as bleaching activating agent, enzyme, fluorescent dye, perfume, etc. incorporated in order to improve bleaching performance and touch, nor have an adverse effect on them. Therefore, if sodium percarbonate is stabilized so as not to be affected by such other ingredients, it becomes possible to provide a high-performance domestic bleaching agent composition having good storage stability.

In a composition containing sodium percarbonate, a transition metal salt such as cobalt, iron or copper salt and a chelating agent, sodium percarbonate is rapidly decomposed by the catalytic action of the transition metal.

When the organic peracid precursor mentioned above as a second example is used, both the activating agent and sodium percarbonate are decomposed by the reaction therebetween. In addition thereto, commercial value as a domestic bleaching agent is remarkably reduced owing to the smell of a carboxylic acid, particularly acetic acid formed by the decomposition of the activating agent.

As stated above, when both the coated sodium percarbonate and the bleaching activating agent are blended in the present invention, there are advantages in that a bleaching agent composition having a high bleaching activity as well as excellent storage stability can be obtained, and it becomes possible to widely choose formulation ingredients such as perfume.

The bleaching agent composition of the present invention contains at least 40 wt.% of the coated sodium percarbonate. The amount of the coated sodium percarbonate to be blended is 40 to 99 wt.%, preferably 40 to 90 wt.%. The amount of the bleaching activating agent to be blended is 0.1 to 60 wt.%, preferably 1 to 40 wt.%.

Coated sodium percarbonate used in the present invention has thus an extremely improved storage stability and, therefore, its influences on other components contained in the detergent such as a fluorescent dye and an enzyme, which exhibit their effect in the washing step, may be minimized. Thus, even if sodium percarbonate is incorporated in a detergent composition containing an enzyme and a fluorescent dye which are easily influenced by the decomposition of sodium percarbonate, the problem of the stability of the composition can be solved according to the present invention. Namely, according to the present invention, a phosphorus-free detergent containing sodium percarbonate in combination with the enzyme and fluorescent dye in which the respective components have excellent storage stabilities can be obtained.

The bleaching detergent composition of the present invention may contain, if desired, water-soluble soaps, anionic, nonionic or amphoteric surfactants, organic or inorganic builders, sequestering agents, bulk fillers, enzymes effective for the deterging, bleaching-activating agents, fluorescent brightening agents and perfumes as will be described below. These additives are not particularly limited but used according to their purposes.

[1] Surfactants:

(1) Straight-chain or branched alkylbenzenesulfonates containing alkyl groups having 10 to 16 carbon atoms in average.

(2) Alkyl or alkenyl ether sulfates containing a straight-chain or branched alkyl or alkenyl group having 10 to 20 carbon atoms in average and containing 0.5 to 8 mol in average of ethylene oxide, propylene oxide, or butylene oxide or two of these three compounds in an ethylene oxide/propylene oxide ratio of 0.1/9.9 to 9.9/0.1 or ethylene oxide/-butylene oxide ratio of 0.1/9.9 to 9.9/0.1.

(3) Alkyl or alkenyl sulfates containing an alkyl or alkenyl group having 10 to 20 carbon atoms in average.

(4) Olefinsulfonates having 10 to 20 carbon atoms in average in the molecule.

(5) Alkanesulfonates having 10 to 20 carbon atoms in average in the molecule.

(6) Saturated or unsaturated fatty acid salts having 10 to 24 carbon atoms in average in the molecule.

(7) Alkyl or alkenyl ether carboxylic acid salts containing an alkyl or alkenyl group having 10 to 20 carbon atoms in average and 0.5 to 8 mol of ethylene oxide, propylene oxide, or butylene oxide or ethylene oxide/propylene oxide in a ratio of 0.1/9.9 to 9.9/0.1 or ethylene oxide/butylene oxide in a ratio of 0.1/9.9 to 9.9/0.1.

(8) α-Sulfofatty acid salts or esters of the formula:

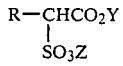

wherein Y represents an alkyl group having 1 to 3 carbon atoms or a counter ion, Z represents a counter ion and R represents an alkyl or alkenyl group having 10 to 20 carbon atoms.

As the counter ions in the anionic surfactants, there may be mentioned ions of alkali metals such as sodium or potassium, those of alkaline earth metals such as calcium or magnesium, ammonium ion, and those of alkanolamines containing 1 to 3 alkanol groups having 2 or 3 carbon atoms such as monoethanolamine, diethanolamine, triethanolamine and triisopropanolamine.

(9) Amino acid-type surfactants of the general formula:

No. 1 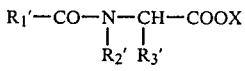

wherein $R_1'$ represents an alkyl or alkenyl group having 8 to 24 carbon atoms, $R_2'$ represents a hydrogen or an alkyl group having 1 or 2 carbon atoms, $R_3'$ represents an amino acid residue and X represents an alkali metal or an alkaline earth metal ion.

No. 2 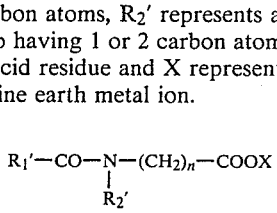

wherein $R_1'$, $R_2'$ and X have the same meaning as above and n represents an integer of 1 to 5.

No. 3 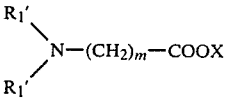

wherein $R_1'$ has the same meaning as above and m represents an integer of 1 to 8.

No. 4 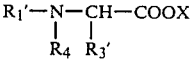

wherein $R_1'$, $R_3'$ and X have the same meaning as above and $R_4$ represents a hydrogen or an alkyl or hydroxyalkyl group having 1 or 2 carbon atoms.

No. 5 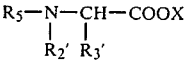

wherein $R_2'$, $R_3'$ and X have the same meaning as above and $R_5$ represents a β-hydroxyalkyl or β-hydroxyalkenyl group having 6 to 28 carbon atoms.

No. 6 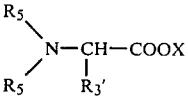

wherein $R_3'$, $R_5$ and X have the same meaning as above.

(10) Phosphate ester surfactants:

No. 1 Alkyl(or alkenyl) acid phosphates:

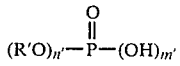

wherein R' represents an alkyl or alkenyl group having 8 to 24 carbon atoms, $n'+m'=3$ and $n'=1-2$.

No. 2 Alkyl(or alkenyl) phosphates:

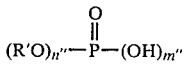

wherein R' has the same meaning as above, $n''+m''=3$ and $n''=1-3$.

No. 3 Alkyl(or alkenyl) phosphate salts:

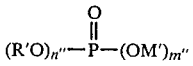

wherein R', n'' and m'' have the same meaning as above and M' represents Na, K or Ca.

(11) Sulfonic acid-type amphoteric sulfactants of the general formulae:

No. 1 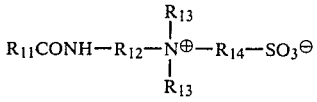

wherein $R_{11}$ represents an alkyl or alkenyl group having 8 to 24 carbon atoms, $R_{12}$ represents an alkylene group having 1 to 4 carbon atoms, $R_{13}$ represents an alkyl group having 1 to 5 carbon atoms and $R_{14}$ represents an alkylene or hydroxyalkylene group having 1 to 4 carbon atoms.

No. 2 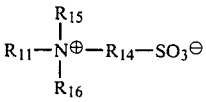

wherein $R_{11}$ and $R_{14}$ have the same meaning as above and $R_{15}$ and $R_{16}$ represent an alkyl or alkenyl group having 8 to 24 or 1 to 5 carbon atoms.

No. 3 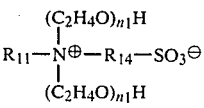

wherein $R_{11}$ and $R_{14}$ have the same meaning as above and $n_1$ represents an integer of 1 to 20.

(12) Betaine-type amphoteric surfactants of the general formulae:

No. 1 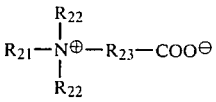

wherein $R_{21}$ represents an alkyl, alkenyl, β-hydroxyalkyl or β-hydroxyalkenyl group having 8 to 24 carbon atoms, $R_{22}$ represents an alkyl group having 1 to 4 carbon atoms and $R_{23}$ represents an alkylene or hydroxyalkylene group having 1 to 6 carbon atoms.

No. 2

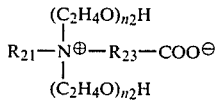

wherein $R_{21}$ and $R_{23}$ have the same meaning as above and $n_2$ represents an integer of 1 to 20.

No. 3

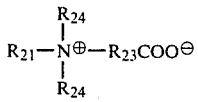

wherein $R_{21}$ and $R_{23}$ have the same meaning as above and $R_{24}$ represents a carboxyalkyl or hydroxyalkyl group having 2 to 5 carbon atoms.

(13) Polyoxyethylene alkyl or alkenyl ethers containing an alkyl or alkenyl group having 10 to 20 carbon atoms in average and 1 to 20 mol of ethylene oxide.

(14) Polyoxyethylene alkylphenyl ethers containing an alkyl group having 6 to 12 carbon atoms in average and 1 to 20 mol of ethylene oxide.

(15) Polyoxypropylene alkyl or alkenyl ethers containing an alkyl or alkenyl group having 10 to 20 carbon atoms in average and 1 to 20 mol of propylene oxide.

(16) Polyoxybutylene alkyl or alkenyl ethers containing an alkyl or alkenyl group having 10 to 20 carbon atoms in average and 1 to 20 mol of butylene oxide.

(17) Nonionic surfactants containing an alkyl or alkenyl group having 10 to 20 carbon atoms in average and 1 to 30 mol, in total, of ethylene oxide and propylene oxide or ethylene oxide and butylene oxide (the ratio of ethylene oxide to propylene oxide or butylene oxide is 0.1/9.9 to 9.9/0.1).

(18) Higher fatty acid alkanolamides or their alkylene oxide adducts of the following formula:

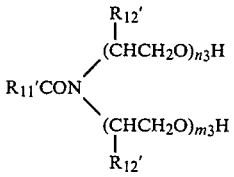

wherein $R_{11}'$ represents an alkyl or alkenyl group having 10 to 20 carbon atoms, $R_{12}'$ represents H or $CH_3$, $n_3$ represents an integer of 1 to 3 and $m_3$ represents an integer of 0–3.

(19) Sucrose/fatty acid esters comprising a fatty acid having 10 to 20 carbon atoms in average and sucrose.

(20) Fatty acid/glycerol monoesters comprising a fatty acid having 10 to 20 carbon atoms in average and glycerol.

(21) Alkylamine oxides of the general formula:

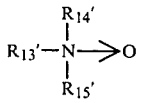

wherein $R_{13}'$ represents an alkyl or alkenyl group having 10 to 20 carbon atoms and $R_{14}'$ and $R_{15}'$ represent an alkyl group having 1 to 3 carbon atoms.

(22) Cationic surfactants of the general formulae:

No. 1

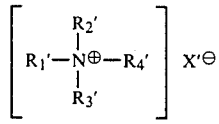

wherein at least one of $R_1'$, $R_2'$, $R_3'$ and $R_4'$ represents an alkyl or alkenyl group having 8 to 24 carbon atoms and others represent an alkyl group having 1 to 5 carbon atoms and X' represents a halogen.

No. 2

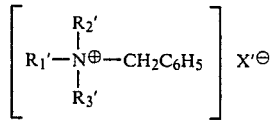

wherein $R_1'$, $R_2'$, $R_3'$ and X' have the same meaning as above.

No. 3

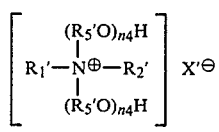

wherein $R_1'$, $R_2'$ and X' have the same meaning as above, $R_5'$ represents an alkylene group having 2 or 3 carbon atoms and $n_4$ represents an integer of 1 to 20.

It is desirable that the composition contains at least 10 wt.% of one or more of the above-mentioned surfactants.

[2] Sequestering agent:

The composition may contain 0 to 50 wt.% of one or more builders selected from the group consisting of alkali metal salts and alkanolamine salts of the following compounds:

(1) Salts of phosphoric acids such as orthophosphoric, pyrophosphoric, tripolyphosphoric, metaphosphoric, hexametaphosphoric or phytic acid.

(2) Salts of phosphonic acids such as ethane-1,1-diphosphonic, ethane-1,2-triphosphonic, or ethane-1-hydroxy-1,1-diphosphonic acid and derivatives thereof, ethane-hydroxy-1,1,2-triphosphonic, ethane-1,2-dicarboxy-1,2-diphosphonic, or methane-hydroxyphosphonic acid.

(3) Salts of phosphonocarboxylic acids such as 2-phosphonobutane-1,2-dicarboxylic, 1-phosphonobutane-2,3,4-tricarboxylic or α-methylphosphonosuccinic acid.

(4) Salts of amino acids such as aspartic or glutamic acid.

(5) Salts of aminopolyacetic acids such as nitrilotriacetic, ethylenediaminetetraacetic or diethylenetriaminepentaacetic acid.

(6) High-molecular electrolytes such as polyacrylic acid, polyaconitic acid, polyitaconic acid, polycitraconic acid, polyfumaric acid, polymaleic acid, polymesaconic acid, poly-α-hydroxyacrylic acid, polyvinylphosphonic acid, sulfonated polymaleic acid, maleic anhydride/diisobutylene copolymer, maleic anhydride/styrene copolymer, maleic anhydride/methyl vinyl ether copolymer, maleic anhydride/ethylene copolymer, maleic anhydride/ethylene cross-linked copolymer, maleic anhydride/vinyl acetate copolymer, maleic anhydride/acrylonitrile copolymer, maleic anhydride/acrylate copolymer, maleic anhydride/butadiene copolymer, maleic anhydride/isoprene copolymer, poly-β-ketocarboxylic acid derived from maleic anhydride and carbon monoxide, itaconic acid/ethylene copolymer, itaconic acid/aconitic acid copolymer, itaconic acid/maleic acid copolymer, itaconic acid-/acrylic acid copolymer, malonic acid/methylene copolymer, mesaconic acid/fumaric acid copolymer, ethylene glycol/ethylene terephthalate copolymer, vinylpyrrolidone/vinyl acetate copolymer, 1-butene-2,3,4-tricarboxylic acid/itaconic acid/acrylic acid copolymer, polyester polyaldehyde carboxylic acid containing a quaternary ammonium group, cis-isomer of epoxysuccinic acid, poly[N,N-bis(carboxymethyl)acrylamide], poly(oxycarboxylic acids), starch succinate, maleate or terephthalate, starch phosphate, dicarboxystarch, dicarboxymethylstarch or cellulose succinate.

(7) Non-dissociating high molecules such as polyethylene glycol, polyvinyl alcohol, polyvinylpyrrolidone or cold water-soluble, urethanized polyvinyl alcohol.

(8) Salts of organic acids such as diglycolic, hydroxydiglycolic, carboxymethyloxysuccinic, cyclopentane-1,2,3,4-tetracarboxylic, tetrahydrofuran-1,2,3,4-tetracarboxylic, tetrahydrofuran-2,2,5,5-tetracarboxylic, citric, lactic or tartaric acid, carboxymethylated products of sucrose, lactose or raffinose, carboxymethylated pentaerythritol, carboxymethylated gluconic acid, condensates of polyhydric alcohols or sugars with maleic or succinic anhydride, condensates of hydroxycarboxylic acids with maleic or succinic anhydride, benzenepolycarboxylic acids such as mellitic acid, ethane-1,1,2,2-tetracarboxylic, ethene-1,1,2,2-tetracarboxylic, butane-1,2,3,4-tetracarboxylic, propane-1,2,3-tricarboxylic, butane-1,4-dicarboxylic, oxalic, sulfosuccinic, decane-1,10-dicarboxylic, sulfotricarbollylic, sulfoitaconic, malic, hydroxydisuccinic or gluconic acid, CMOS or builder M.

(9) Aluminosilicates:

No. 1 Crystalline aluminosilicates of the formula:

$$x'(M_2'O \text{ or } M''O).Al_2O_3.y'(SiO_2).w'(H_2O)$$

wherein M' represents an alkali metal atom, M'' represents an alkaline earth metal atom exchangeable with calcium and x', y' and w' represent each a molar number of the respective components and generally, $0.7 \leqq x' \leqq 1.5$, $0.8 \leqq y' \leqq 6$ and w' being any positive number.

No. 2 As the detergent builders, those of the following general formula are particularly preferred:

$$Na_2O.Al_2O_3.nSiO_2.wH_2O$$

wherein n represents a number of 1.8 to 3.0 and w represents a number of 1 to 6.

No. 3 Amorphous aluminosilicates of the formula:

$$x(M_2O).Al_2O_3.y(SiO_2).w(H_2O)$$

wherein M represents a sodium and/or potassium atom and x, y and w represent each a molar number of the respective components within the following ranges:

$$0.7 < x \leqq 1.2$$

$$1.6 \leqq y \leqq 2.8$$

w being any positive number including 0.

No. 4 Amorphous aluminosilicates of the formula:

$$X(M_2O).Al_2O_3.Y(SiO_2).Z(P_2O_5).\omega(H_2O)$$

wherein M represents Na or K and X, Y, Z and ω represent each a molar number of the respective components within the following ranges:

$$0.20 \leqq X \leqq 1.10$$

$$0.20 \leqq Y \leqq 4.00$$

$$0.001 \leqq Z \leqq 0.80$$

ω being any positive number including 0.

[3] Alkalies and inorganic electrolytes:

Further, one or more of alkali metal salts shown below may be contained in the composition in an amount of 1 to 50 wt.%, preferably 5 to 30 wt.%, as alkalies or inorganic electrolytes: silicates, carbonates and sulfates. Organic alkalies include, for example, triethanolamine, diethanolamine, monoethanolamine and triisopropanolamine.

The following explains in detail incorporation of an alkali metal silicate into the coating agent.

As to the coating of sodium percarbonate which is an indispensable step for improving its storage stability, the mechanical strength of the coating is remarkably improved when a borate is used in combination with an alkali metal silicate. Thus, there is no fear of damaging the coating during the course of handling, particularly until the stage of blending with powdered detergents.

Suitable alkali metal silicates are those of the formula $Na_2O.nSiO_2$, wherein n represents a molar ratio of $SiO_2/Na_2O$, and is 0.5 to 4. Examples of such alkali metal silicates are an aqueous solution of a crystalline sodium silicate such as sodium orthosilicate ($2Na_2O.SiO_2.xH_2O$, n=0.5), sodium sesquisilicate ($3Na_2O.2SiO_2.xH_2O$, n=0.67), and sodium metasilicate ($Na_2O.SiO_2.xH_2O$, n=1), an aqueous solution of an amorphous sodium silicate such as $Na_2O.nSiO_2$ (n=1–4) and dehydrated sodium silicate powder thereof.

The so-coated sodium percarbonate exhibits an excellent storage stability even when incorporated in conventional powdered detergents (spray-dried products), particularly low-phosphorus or phosphorus-free detergents containing zeolite blended therein. Further, in addition to a synergistic coating effect obtained by using the borate and the alkali metal silicate in combination, the strength of particles and the coating is improved by the use of the alkali metal silicate without deteriorating the solubility of sodium percarbonate. Thus, there is no fear of damaging the coating during stages until sodium percarbonate is blended with powdered detergents.

[4] Antiredeposition agents:

The composition may contain 0.1 to 5% of one or more of the following compounds as antiredeposition agents: polyethylene glycol, polyvinyl alcohol, polyvinylpyrrolidone and carboxymethyl cellulose.

[5] Fluorescent dyes:

Fluorescent dyes represented by, for example, the following structural formulae (w), (x) and (y) may also be contained in the composition:

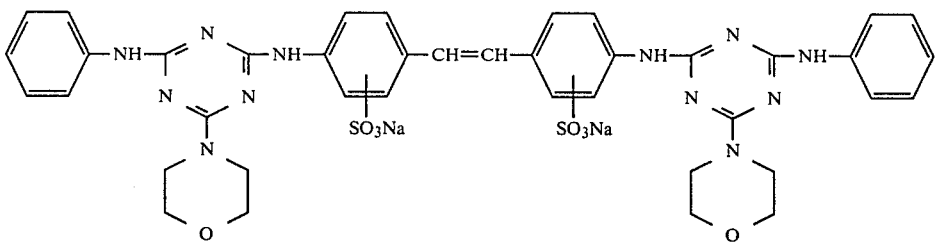

(w)

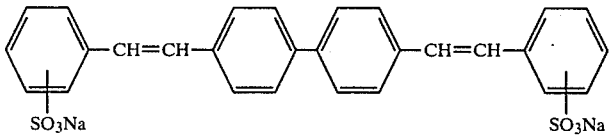

(x)

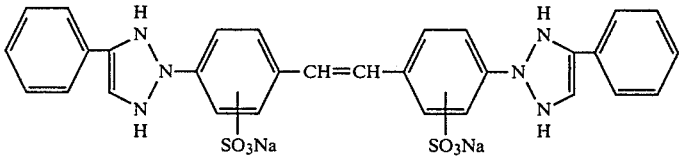

(y)

[6] Enzymes (those exhibiting their essential enzymatic effects in the deterging step):

In respect of reactivity, enzymes may be classified into groups of hydrolases, hydrases, oxidoreductases, desmolases, transferases and isomerases. Among them, hydrolases are particularly preferred. They include protease, esterase, carbohydrase and nuclease.

Particular examples of proteases are pepsin, trypsin, chymotrypsin, collagenase, keratinase, elastase, subtilisin, BPN, papain, bromelin, carboxypeptidases A and B, aminopeptidase, and aspergillopeptidases A and B.

Particular examples of esterases are gastric lipase, pancreatic lipase, vegetable lipases, phospholipases, cholinesterases and phosphatases.

As the carbohydrases, there may be mentioned, for example, cellulase, maltase, saccharase, amylase, pectinase, lysozyme, $\alpha$-glycosidase and $\beta$-glycosidase.

The coated sodium percarbonate according to the invention exists stably together with an enzyme in the composition. The stability of the composition which comprises said coated sodium percarbonate and an enzyme is further improved by incorporating therein a synthetic zeolite in an amount of not less than 5 percent by weight. Such composition in practice comprises 50 to 99 percent by weight of said coated sodium percarbonate, 0.1 to 10 percent by weight as protease of 2.0 Anson unit per gram, and from 5 to 100 percent by weight, based on the weight of said coated sodium percarbonate, of a zeolite. The Anson unit is explained in Anson, M. L., Journal of General Physiolosy, vol. 22(1939), pages 79 to 89.

[7] Blueing agents:

Various blending agents may be incorporated in the composition, if necessary. Blueing agents of, for example, the following structure are recommended:

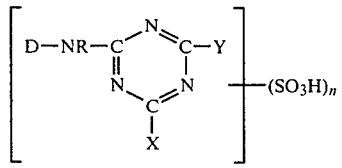

wherein D represents blue or purple monoazo, disazo or anthraquinone dyestuff residue, X and Y represent each a hydroxyl group, amino group, aliphatic amino group which may be substituted with a hydroxyl, sulfonic acid, carboxylic acid or alkoxyl group, or an aromatic amino or alicyclic amino group which may be substituted with a halogen atom or hydroxyl, sulfonic acid, carboxylic acid, lower alkyl or lower alkoxyl group and R represents a hydrogen atom or a lower alkyl group excluding a case in which R represents a hydrogen atom and (1) both X and Y represent hydroxyl or alkanolamino groups at the same time or (2) one of X and Y represents a hydroxyl group and the other represents an alkanolamino group, and n represents an integer of at least 2, and

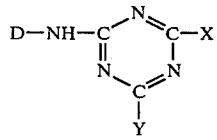

wherein D represents a blue or purple azo or anthraquinone dyestuff residue and X and Y represent the same or different alkanolamino residue or hydroxyl group.

[8] Caking inhibitors:

The following caking inhibitors may also be contained in the composition: p-toluenesulfonates, xylenesulfonates, acetates, sulfosuccinates, talc, finely pulverized silica, clay, calcium silicate (such as Micro-cells of Johns-Manvill Co.), calcium carbonate or magnesium oxide.

[9] Antioxidants:

The antioxidants include, for example, tertbutylhydroxytoluene, 4,4'-butylidenebis(6-tertbutyl-3-methylphenol), 2,2'-butylidenebis(6-tertbutyl-4-methylphenol), monostyrenated cresol, distyrenated cresol, monostyrenated phenol, distyrenated phenol and 1,1'-bis-(4-hydroxyphenyl)cyclohexane.

[10] Bleaching activating agents:

The bleaching activating agents are compounds which form organic peracids in the presence of peroxy compounds in an aqueous alkali solution. They may be classified into the following three groups:

(1) organic acid anhydrides, (2) ester compounds, and (3) N-acyl compounds.

As particular examples of the bleaching activating compounds, there may be mentioned triacetyl cyanurate (TACA), sodium p-acetoxybenzenesulfonate (SABS), tetraacetylglycouryl (TAGU) acetylsalicyclic acid, N-acetylimidazole (AID), N,N,N',N'-tetraacetylethylenediamine (TAED) and pentaacetyl-$\beta$-D-glucose.

[11] Stabilizers for peroxides:

These include, for example, magnesium silicate, magnesium sulfate, magnesium oxide and magnesium chloride.

Accordingly, sodium percarbonate to be incorporated in the bleaching detergent of the present invention can be stabilized by coating it with a coating agent containing a borate and a magnesium compound. As the borates, sodium borate is preferred, and sodium metaborate is particularly preferred. As the magnesium compounds, preferably one or more members selected from the group consisting of magnesium chloride, magnesium oxide, magnesium sulfate and magnesium silicate are used. Further, the coating agent may contain a sequestering agent such as an ethylenediaminetetraacetate or a nitrilotriacetate.

Sodium percarbonate is used in an amount of preferably 0.1 to 30 wt.% based on the amount of the coating agent. The borate is used in an amount of preferably 10 to 95 wt.%, and the magnesium compound is used in an amount of preferably 5 to 70 wt.% based on the amount of the coating agent. Generally, it is preferred to use the magnesium compound in an amount not more than that of the borate.

On the contrary, the inventors have made further studies and found that when a borate and a magnesium compound are used in combination, a coated sodium percarbonate having more excellent storage stability can be obtained by the synergistic effect of the coating powder of the borate and the stabilizing power of the magnesium compound, and that when this coated sodium percarbonate is incorporated in powdered detergents, bleaching detergents having remarkably excellent storage stability can be obtained. The present invention is based on these findings.

Examples of magnesium compounds include magnesium sulfate, magnesium chloride, magnesium oxide, magnesium hydroxide, magnesium silicate, magnesium nitrate, magnesium phosphate and magnesium carbonate in an anhydrous form or in a hydrated form, and magnesium salts of various organic acids. Among these, magnesium sulfate, magnesium chloride, magnesium oxide and magnesium silicate in an anhydrous form or in a hydrated form are particularly preferred.

The following examples are provided to illustrate the coated sodium percarbonate according to the invention.

EXAMPLE 1

Wetted sodium percarbonate having a moisture content of 10% and a dry average particle size of 480$\mu$ obtained by a reaction between hydrogen peroxide and sodium carbonate in an aqueous solution, was fed to a continuous mixer at a rate of 5.3 kg/min by means of a continuous feeder. Sodium metaborate dihydrate having an average particle size of 150$\mu$ was also fed to the this mixer at a rate of 0.178 kg/min by means of a continuous feeder. The feed rate was adjusted so as to give a residence time of 5 min in the mixer. The mixture was continuously supplied to a fluidized dryer to dry it at 130° C.

The amount of boron in the coated sodium percarbonate was determined to be 0.42% in terms of boron. The coated sodium percarbonate was mixed with various second components and the stability of the mixtures was measured. The results are given in Table 1. The stability was expressed by available oxygen residue obtained after a required amount of a sample was charged in a resin vessel provided with pinholes and left to stand at 50° C. and 80% RH for 24 hours.

TABLE 1

| Uncoated PC (amount: %) | Coated PC (amount: %) | Second component (amount: %) | Stability (%) |
|---|---|---|---|
| | coated PC (90) | zeolite A-4 (10) | 88.8 |
| uncoated PC (90) | | zeolite A-4 (10) | 32.5 |
| | coated PC (90) | sodium metasilicate (10) | 45.6 |
| uncoated PC (90) | | sodium metasilicate (10) | 32.0 |
| | coated PC (50) | acid sodium pyrophosphate (50) | 98.2 |
| uncoated PC (50) | | acid sodium pyrophosphate (50) | 90.2 |
| | coated PC (50) | sodium tripolyphosphate (wet process) (50) | 93.8 |
| uncoated PC (50) | | sodium tripolyphosphate (wet process) (50) | 82.8 |

Note:
PC means sodium percarbonate.

EXAMPLE 2

3.4 g of wetted sodium percarbonate having a moisture content of 12% and a dry average particle size of 400$\mu$ and 0.1 kg of sodium borate decahydrate were charged in a batch mixer, and mixed together for one min. The mixture was dried in a fluidized dryer at 160° C. The amount of boron in the coated sodium percarbonate was determined to be 0.40% in terms of boron.

For the purpose of comparison, the above procedure was repeated with the exception that 0.16 Kg of sodium carbonate, 0.78 Kg of colloidal silica ($SiO_2$ content of 20%) and 0.31 Kg of No. 3 sodium silcate were used as coating agents in place of sodium borate decahydrate. The resulting coated sodium percarbonate was mixed with a commercially available detergent A (a phosphorus-free detergent containing zeolite blended therewith) in a mixing ratio of 9:1 in a resin vessel provided with pinholes, and left to stand at 40° C. and 80% RH for two weeks. Thereafter, available oxygen residue (stability) was measured. The results are given in Table 2.

TABLE 2

| | Coating agent | Stability (%) |
|---|---|---|
| Present invention | sodium borate decahydrate | 92.4 |
| Comparative example | sodium carbonate | 55.7 |
| | colloidal silica | 74.0 |
| | No. 3 sodium silicate | 70.0 |
| | uncoated | 44.6 |

EXAMPLE 3

The coated PC's prepared in Examples 1 and 2 were subjected to a storage stability test under the following conditions:

(1) 10 wt.% of the coated PC was mixed with a commercially available detergent B (a phosphorus-free detergent containing zeolite)

(2) 10 wt.% of the coated PC was mixed with a commercially available detergent C (a phosphorus-containing detergent containing sodium tripolyphosphate).

10 g of each of the above mixtures was charged in a 50 cc plastic vessel. The vessel was closed and left to stand at 40° C. and 80% RH for 14 days. Thereafter, available oxygen residue was determined according to the following equation:

$$\text{available oxygen residue (\%)} = \frac{\text{available oxygen after storage}}{\text{available oxygen before storage}} \times 100$$

The available oxygen was measured according to a 0.1N potassium permanganate titration method.

For the purpose of comparison, (1) uncoated PC obtained by drying wetted PC as such and (2) sodium perborate (PB) in addition to the coated PC of the present invention were also tested.

| | PC coated with $NaBO_2.2H_2O$ | PC coated with $NaB_2O_7.10H_2O$ | Uncoated PC | PB |
|---|---|---|---|---|
| Commercially available detergent B (phosphorus-free, and containing zeolite) | 90.1 | 88.0 | 30.7 | 91.0 |
| Commercially available detergent C (containing phosphorus and sodium tripolyphosphate) | 94.5 | 92.0 | 90.3 | 94.9 |

The following examples will further illustrate the bleaching detergent composition.

EXAMPLE 4

100 g of sodium percarbonate was charged in a stirring type-mixer. A 25% aqueous solution of 5 g of sodium metaborate tetrahydrate ($NaBO_2.4H_2O$) (prepared by dissolving under heating) was sprayed thereon under stirring at 250 rpm. After stirring for 10 min, the mixture was dried with hot air to obtain coated sodium percarbonate.

For comparison, sodium percarbonate coated with boric acid (2.4 g of boric acid per 100 g of sodium percarbonate) was also prepared.

10 wt.% of the coated sodium percarbonate was homogeneously mixed in a phosphorus-free powdery detergent of the following composition to obtain a bleaching detergent according to the present invention:

| Phosphorus-free bleaching detergent composition (the present invention): | wt. % |
|---|---|
| sodium dodecylbenzenesulfonate | 20.0 |
| synthetic zeolite (type 4A) | 20.0 |
| sodium silicate (JIS No. 2) | 10.0 |
| sodium carbonate | 5.0 |
| fluorescent dye | 0.5 |
| sodium salt of carboxymethylcellulose | 1.0 |
| enzyme (alcalase) | 0.3 |
| sodium percarbonate (coated with sodium metaborate according to the invention) | 10.0 |
| water | 5.0 |
| sodium sulfate | balance |
| Total | 100 |

Three samples of the above composition containing sodium percarbonate coated with sodium metaborate according to the present invention, sodium percarbonate coated with boric acid for comparison and sodium percarbonate having no coating were subjected to storage stability tests in the same way in Example 3. The results are shown in Table 3.

TABLE 3

| | Coating of sodium percarbonate | Available oxygen residue (%) |
|---|---|---|
| Bleaching detergent of the invention | 5% sodium metaborate ($NaBO_2.4H_2O$) | 75.3 |
| Comparative Example 1 | 2.4% boric acid ($H_3BO_3$) | 51.2 |
| Comparative Example 2 | none | 31.1 |

*coating rate of $NaBO_2$: 2.4%.

It is apparent from Table 3 that the coating effects of sodium metaborate in the bleaching detergent of the present invention were far superior to those of the boric acid coating.

The bleaching detergent in this example was an absolutely phosphorus-free detergent containing zeolite. However, it had a high stability due to the sodium metaborate coating.

EXAMPLE 5

Sodium percarbonate was coated with a combination of sodium metaborate with another coating agent in the same way as in Example 4. The coating agents used are shown below. Amounts of the coating agents are shown by wt. % bsed on sodium percarbonate.

(1) 5% sodium metaborate ($NaBO_2.4H_2O$)+5% polyethylene glycol (PEG, molecular weight: 6000), (2) 5% sodium metaborate+5% sodium carbonate, (3) 5% sodium metaborate+0.5% disodium ethylenediaminetetraacetate (EDTA), (4) 5% sodium metaborate+0.5% EDTA.di-triethanolamine salt, and (5) 5% sodium metaborate+0.5% trisodium nitrilotriacetate (NTA).

Six samples (i.e., the above-mentioned five samples of coated sodium percarbonate and non-coated sodium percarbonate) were incorporated in the same phosphorus-free bleaching detergent as in Example 4 (amount of sodium percarbonate: 10 wt.%). The resulting compositions were subjected to the same storage stability test as in Example 4 to obtain the results shown in Table 4.

TABLE 4

| | Coating of sodium percarbonate | Available oxygen residue (%) |
|---|---|---|
| 1 | $NaBO_2.4H_2O$ + PEG<br>5% 5% | 82.3 |
| 2 | $NaBO_2.4H_2O$ + $Na_2CO_3$<br>5% 5% | 77.7 |
| 3 | $NaBO_2.4H_2O$ + EDTA.2Na<br>5% 0.5% | 83.0 |
| 4 | $NaBO_2.4H_2O$ + EDTA 2TEA*<br>5% 0.5% | 86.6 |
| 5 | $NaBO_2.4H_2O$ + NTA.3Na<br>5% 0.5% | 84.4 |
| 6 | not coated | 30.5 |

*EDTA di-triethanolamine salt.

It is apparent from Table 4 that when sodium metaborate was used in combination with another coating agent, a quite excellent storage stability was obtained. Particularly when sodium metaborate was used in combination with an organic high molecular compound such as PEG or sequestering agent such as EDTA or NTA, a synergism was attained to improve the storage stability.

EXAMPLE 6

The solubilities, compression strengths and disintegrating properties of the coated sodium percarbonates prepared in Example 5 were examined to obtain the results shown in Table 5.

[TEST METHODS]

Solubility 1 l of city water was charged in a 1 l beaker. 1 g of granular sodium percarbonate was added thereto and the mixture was stirred at 200 rpm. A time required until electric conductivity of the solution became constant after the initiation of the stirring was measured and shown as dissolution time.

COMPRESSION STRENGTH

A load was applied to a given amount of a sample under given conditions by means of an autographic recording device and the load required for 1 cm compression was determined.

DISINTEGRATING PROPERTIES 100 g of a sample which passed through a 12-mesh sieve but did not pass through an 80-mesh sieve was charged in a 500 ml wide-mouth bottle made of a polymer. 50 g of stainless steel balls (3ϕ) were charged therein and a stopper was applied to the bottle. The bottle was fixed on an agitating device and agitated at 360 rpm for 10 min (amplitude: 4.5 cm). The disintegrating properties were expressed by the amount (wt.%) of the sample passed through the 80-mesh sieve. The smaller the amount (%), the better.

TABLE 5

| | Coating of sodium percarbonate | Solubility (sec) | Compression strength ($kg/cm^2$) | Disintegrating properties (%) |
|---|---|---|---|---|
| 1 | $NaBO_2.4H_2O$ + PEG<br>5% 5% | 96 | 20.3 | 13.0 |
| 2 | $NaBO_2.4H_2O$ + $NaCO_3$<br>5% 5% | 111 | 18.8 | 15.8 |
| 3 | $NaBO_2.4H_2O$ + EDTA.2Na<br>5% 0.5% | 93 | 21.0 | 13.8 |
| 4 | $NaBO_2.4H_2O$ + EDTA.2TEA<br>5% 0.5% | 92 | 20.8 | 13.9 |
| 5 | $NaBO_2.4H_2O$ + NTA.3Na<br>5% 0.5% | 95 | 20.8 | 14.2 |
| 6 | not coated | 90 | 20.6 | 13.4 |

It is apparent from Table 5 that the solubility, compression strength and disintegrating property of the sodium percarbonate were substantially unchanged by coating the same according to the process of the present invention.

EXAMPLE 7

20 kg of wet sodium percarbonate was charged in a centrifugal diffusion type mixer (mixer, FKM-130 D, T.M. Engineering Co., Ltd.). A powdery coating agent was added thereto under stirring and they were mixed for 10 min in total. Then, the coated sodium percarbonate was taken out and dried with hot air.

The coating agents used were as follows:

(1) 5% sodium metaborate ($NaBO_2.4H_2O$)+0.5% EDTA.2TEA, (2) 4.54% borax ($Na_2B_4O_7.10H_2O$)+0.5% EDTA.2-TEA, and (3) 2.4% boric acid ($H_3BO_3$)+0.5% EDTA.2TEA (The percentages are given by weight based on sodium percarbonate)

The three samples (i.e., two samples of coated sodium percarbonate according to the present invention and one comparative sample) and uncoated sodium percarbonate were incorporated in an amount of 10 wt.% in the following phosphorus-free bleaching detergent composition in the same manner as in Example 4 and 5. The results of the storage stability tests carried out in the same manner as in Example 4 are shown in Table 6. Residual activity of an enzyme (2.0M alcalase) incorporated in the same manner as above was also determined. Enzymatic activity residue was determined according to the following formula and also shown in Table 6:

$$\text{enzymatic activity residue (\%)} = \frac{\text{enzymatic activity after storage}}{\text{enzymatic activity before storage}} \times 100$$

The method of measuring the residual activity of enzyme is described in J.B.C. 244 (4), pp. 789–793 (1969) and Analyst 96, pp. 159–163 (1971).

| Phosphorus-free bleaching detergent composition: | wt. % |
|---|---|
| sodium dodecylbenzenesulfonate | 20.0 |
| synthetic zeolite (type 4A) | 20.0 |
| sodium silicate (JIS No. 2) | 10.0 |
| sodium carbonate | 5.0 |
| fluorescent dye | 0.5 |
| sodium salt of carboxymethylcellulose | 1.0 |
| enzyme (2.0 M alcalase) | 0.3 |
| sodium percarbonate (coated) | 10.0 |
| water | 5.0 |

-continued

| Phosphorus-free bleaching detergent composition: | wt. % |
|---|---|
| sodium sulfate | balance |
| Total | 100 |

TABLE 6

| | Coating of sodium percarbonate | Available oxygen residue (%) | Enzymatic activity residue (%) |
|---|---|---|---|
| 1 | $NaBO_2.4H_2O$ + EDTA.2TEA<br>5%* 0.5% | 90.1 | 95.4 |
| 2 | $Na_2B_4O_7.10H_2O$ + EDTA.2TEA<br>4.54%* 0.5% | 88.2 | 94.4 |
| 3 | $H_3BO_3$ + EDTA.2TEA<br>2.4% 0.5% | 73.8 | 90.2 |
| 4 | not coated | 32.0 | 80.3 |

*Coating rate of anhydrous coating agent: 2.4%

It is apparent from Table 6 that in the phosphorus-free bleaching detergents (1) and (2) according to the present invention, stability of sodium percarbonate was extremely high and stability of the enzyme was also excellent, though they contained zeolite.

EXAMPLE 8

10 wt.% of the coated sodium percarbonate of the present invention prepared in Example 7 (sodium percarbonate coated with $NaBO_2.4H_2O$ or $Na_2B_4O_7.10H_2O$) or one of the two comparative samples (sodium percarbonate coated with $H_3BO_3$ or uncoated sodium percarbonate) was incorporated in a powdery bleaching detergent of the following composition. They were subjected to the storage stability test to examine available oxygen residue in sodium percarbonate and enzymatic activity residue (2.0M alcalase). The results are shown in Table 5. The test method was the same as in Example 4 and 7.

| Bleaching detergent composition: | wt. % |
|---|---|
| sodium dodecylbenzenesulfonate | 20.0 |
| sodium tripolyphosphate | 18.0 |
| sodium silicate (JIS No. 2) | 10.0 |
| sodium carbonate | 5.0 |
| fluorescent dye | 0.5 |
| sodium salt of carboxymethylcellulose | 0.5 |
| enzyme (2.0 M alcalase) | 0.3 |
| sodium percarbonate | 10.0 |
| water | 5.0 |
| sodium sulfate | balance |
| Total | 100 |

Total 7

| | Coating of sodium percarbonate | Available oxygen residue (%) | Enzymatic activity residue (%) |
|---|---|---|---|
| 1 | $NaBO_2.4H_2O$ + EDTA.2TEA<br>5% 0.5% | 95.8 | 84.8 |
| 2 | $Na_2B_4O_7.10H_2O$ + EDTA.2TEA<br>5% 0.5% | 96.0 | 85.0 |
| 3 | $H_3BO_3$ + EDTA.2TEA<br>5% 0.5% | 90.2 | 80.4 |

Total 7-continued

| | Coating of sodium percarbonate | Available oxygen residue (%) | Enzymatic activity residue (%) |
|---|---|---|---|
| 4 | not coated | 88.8 | 60.5 |

The bleaching detergent composition in this example contained STPP as in the conventional detergent compositions. Samples (1) and (2) according to the present invention exhibited quite excellent storage stabilities. This fact indicates that the bleaching detergents of the present invention have a quite high storage stability irrespective of the presence or absence of zeolite.

EXAMPLE 9

100 g of sodium percarbonate was charged in an agitating mixer. A 25% aqueous solution of 5 g of sodium metaborate ($Na_2BO_2.4H_2O$) (prepared by dissolving the metaborate in water with heating) and a 25% aqueous solution of 1 g (on a solid base) of sodium silicate (JIS No. 3) ($Na_2O.3SiO_2.aq$) were sprayed thereon with stirring at 250 r.p.m. After stirring for 10 min, sodium percarbonate was dried with hot air to obtain coated sodium percarbonate.

For the purpose of comparison, sodium percarbonate coated with only sodium metaborate (7.1 g of $Na_2BO_2.4H_2O$ per 100 g of sodium percarbonate), sodium percarbonate coated with boric acid (3.4 g of boric acid per 100 g of sodium percarbonate), sodium percarbonate coated with boric acid and sodium silicate (JIS No. 3) (2.4 g of boric acid and 1 g (on a solid basis) of JIS No. 3 sodium silicate per 100 g of sodium carbonate), and sodium percarbonate coated with only the silicate (3.4 g (on a solid basis) of JIS No. 3 sodium silicate per 100 g of sodium percarbonate) were also prepared.

10 wt.% of each of these coated sodium percarbonates was uniformly incorporated in a powdered phosphorus-free detergent having the following composition to obtain a bleaching detergent:

| phosphorus-free bleaching detergent composition | wt. % |
|---|---|
| sodium dodecylbenzenesulfonate | 20.0 |
| synthetic zeolite (type 4A) | 20.0 |
| sodium silicate (JIS No. 2) | 10.0 |
| sodium carbonate | 5.0 |
| fluorescent dye | 0.5 |
| sodium salt of carboxymethylcellulose | 1.0 |
| enzyme (alcalase) | 0.3 |
| sodium percarbonate | 10.0 |
| water | 5.0 |
| sodium sulfate | balance |
| Total | 100 |

Six samples of the above compositions containing, as sodium percarbonate to be incorporated, one coated with sodium metaborate and sodium silicate according to the present invention, one coated with only sodium metaborate, one coated with boric acid, one coated with boric acid and sodium silicate, one coated with only sodium silicate and uncoated sodium percarbonate for the purpose of comparison were subjected to a storage stability test. The results are given in Table 8.

TABLE 8

| | Coating of sodium percarbonate* | Available oxygen residue (%) |
|---|---|---|
| Bleaching detergent of | 5% sodium metaborate ($NaBO_2.4H_2O$) | 85.4 |

TABLE 8-continued

| | Coating of sodium percarbonate* | | Available oxygen residue (%) |
|---|---|---|---|
| the present invention | 1% | sodium silicate (JIS No. 3) | |
| Comparative Example 3 | 7.1% | sodium metaborate ($NaBO_2.4H_2O$) | 79.7 |
| Comparative Example 4 | 3.4% | boric acid ($H_3BO_3$) | 60.8 |
| Comparative Example 5 | 2.4% | boric acid ($H_3BO_3$) | 63.3 |
| | 1% | sodium silicate (JIS No. 3) | |
| Comparative Example 6 | 3.4% | sodium silicate (JIS No. 3) | 45.3 |
| Comparative Example 7 | | none | 31.1 |

*The amount (coating ratio) of the coating agent was 3.4% (on a water-free basis) based on sodium percarbonate in all cases.

It is apparent that the available oxygen residue of the bleaching detergent containing sodium percarbonate coated with sodium metaborate and sodium silicate of the present invention, is higher than those of the bleaching detergents of Comparative Examples 3 to 7, and the bleaching detergent of the present invention is superior in the coating effect to those of Comparative Examples.

The bleaching detergent used in this example does not contain phosphorus at all and is a phosphorus-free detergent containing zeolite blended therewith. But the bleaching detergent according to the present invention exhibits a good stability because of an excellent coating effect due to sodium metaborate and sodium silicate.

EXAMPLE 10

The solubility, compression strength and disintegrating property of the coated sodium percarbonates prepared in Example 9 were examined. The results are given in Table 9.

TABLE 9

| | Coating of sodium percarbonate* | | Solubility (sec) | Compression strength ($kg/cm^2$) | Disintegrating property (%) |
|---|---|---|---|---|---|
| Bleaching detergent of the present invention | 5%<br>1% | $NaBO_2.4H_2O$<br>sodium silicate** | 98 | 19.5 | 6.2 |
| Comparative Example 3 | 7.1% | $NaBO_2.4H_2O$ | 96 | 20.7 | 13.9 |
| Comparative Example 4 | 3.4% | boric acid ($H_3BO_3$) | 95 | 21.0 | 14.4 |
| Comparative Example 5 | 2.4%<br>1% | boric acid<br>sodium silicate | 96 | 19.6 | 7.7 |
| Comparative Example 6 | 3.4% | sodium silicate | 109 | 19.4 | 8.2 |
| Comparative Example 7 | | none | 90 | 20.6 | 13.4 |

*The amount (on a water-free solid basis) of the coating was 3.4%.
**JIS No. 3, sodium silicate on a solid basis.

It is apparent from Table 9 that the solubility is substantially unchanged though sodium percarbonate is coated according to the process of the present invention, and the disintegrating property is remarkably improved when coated with sodium metaborate and sodium silicate according to the process of the present invention.

EXAMPLE 11

Sodium percarbonate was coated by the procedure of Example 9 using various sodium silicates in combination with sodium metaborate. The following coating agents were used:

1 5% $NaBO_2.4H_2O$+1% (on a solid basis) sodium orthosilicate,
2 5% $NaBO_2.4H_2O$+1% (on a solid basis) sodium metasilicate,
3 5% $NaBO_2.4H_2O$+1% (on a solid basis) sodium silicate (JIS No. 1),
4 5% $NaBO_2.4H_2O$+1% (on a solid basis) sodium silicate (JIS No. 2),
5 5% $NaBO_2.4H_2O$+1% (on a solid basis) sodium silicate (JIS No. 3), and
6. 7 % $NaBO_2.4H_2O$ Each of seven samples (i.e., the above six coated sodium percarbonates and uncoated sodium percarbonate) in an amount of 10 wt.% in terms of sodium percarbonate was incorporated in a phosphorus-free bleaching detergent having the same composition as that of Example 9. A storage stability test was conducted in a similar manner to that described in Example 9. Further, these seven sodium percarbonates were subjected to a disintegrating test in a similar manner to that described in Example 10. The samples of sodium percarbonates after the completion of the disintegrating test were further subjected to the storage stability test. The results are given in Table 10.

TABLE 10

| | Coating of sodium percarbonate* | | Available oxygen residue (%) | Disintegrating property (%) | Available oxygen residue, % by storage test after disintegration test |
|---|---|---|---|---|---|
| 1 | 5%<br>1% | $NaBO_2.4H_2O$ +<br>sodium orthosilicate | 81.0 | 10.8 | 75.1 |
| 2 | 5%<br>1% | $NaBO_2.4H_2O$ +<br>sodium metasilicate | 82.3 | 9.0 | 79.8 |
| 3 | 5%<br>1% | $NaBO_2.4H_2O$ +<br>sodium silicate (JIS No. 1) | 82.3 | 7.8 | 82.1 |
| 4 | 5%<br>1% | $NaBO_2.4H_2O$ +<br>sodium silicate (JIS No. 2) | 84.0 | 6.2 | 83.0 |
| 5 | 5%<br>1% | $NaBO_2.4H_2O$ +<br>sodium silicate (JIS No. 3) | 85.4 | 6.2 | 84.4 |
| 6 | 7.1% | $NaBO_2.4H_2O$ | 79.7 | 13.9 | 72.9 |
| 7 | | none | 31.1 | 13.4 | 30.5 |

*The coating ratio on a water-free basis was 3.4%.

It is apparent from Table 10 that products (1) to (5) of the present invention exhibits an excellent storage stability by the synergistic coating effect of the borate and the silicate. By using the borate and the silicate in combination, the coated particles have a strength which could not be obtained by the coating of only the borate. As seen from the storage test result after the disintegrating test, damage resistance can be imparted to the coated particles. Therefore, the coating of the coated particles of the present invention is hardly damaged on the way of transportation in the blending stage with bleaching detergents and, even when the particles are damaged, the storage stability is not substantially deteriorated.

EXAMPLE 12

Sodium percarbonate was coated by the procedure of Example 9 with the exception that sodium metaborate and sodium silicate were used in combination with other coating agents shown below. The amount of the coating agent was wt.% based on sodium percarbonate.

1 5% $NaBO_2.4H_2O$+1% (on a solid base) sodium silicate (JIS No. 3)+5% polyethylene glycol (PEG, molecular weight=6000),
2 5% $NaBO_2.4H_2O$+1% (on a solid basis) sodium silicate (JIS No. 3)+5% sodium carbonate,
3 5% $NaBO_2.4H_2O$+1% (on a solid basis) sodium silicate (JIS No. 3)+0.5% disodium ethylenediaminetetraacetate (EDTA),
4 5% $NaBO_2.4H_2O$+1% (on a solid basis) sodium silicate (JIS No. 3)+0.5% EDTA di(triethanolamine) salt, and
5 5% $NaBO_2.4H_2O$+1% (on a solid basis) sodium silicate (JIS No. 3)+0.5% trisodium nitrilotriacetate (NTA)

10 wt.% of each of six samples (i.e., the above five coated sodium percarbonates and uncoated sodium percarbonate) was incorporated in the phosphorus-free bleaching detergent having the same composition as that of Example 9. A storage stability test was conducted in a similar manner to that described in Example 9. The results are given in Table 11.

TABLE 11

| | Coating of sodium percarbonate | | | | | Available oxygen residue (%) |
|---|---|---|---|---|---|---|
| 1 | $NaBO_2.4H_2O$ 5% | + | No. 3 sodium silicate 1% | + | PEG 5% | 87.2 |
| 2 | $NaBO_2.4H_2O$ 5% | + | No. 3 sodium silicate 1% | + | $Na_2CO_3$ 5% | 86.6 |
| 3 | $NaBO_2.4H_2O$ 5% | + | No. 3 sodium silicate 1% | + | EDTA.2Na 0.5% | 87.7 |
| 4 | $NaBO_2.4H_2O$ 5% | + | No. 3 sodium silicate 1% | + | EDTA.2TEA 0.5% | 90.9 |
| 5 | $NaBO_2.4H_2O$ 5% | + | No. 3 sodium silicate 1% | + | NTA.3Na 0.5% | 88.8 |
| 6 | | | none | | | 30.5 |

It is apparent from Table 11 that sodium percarbonate exhibits an excellent storage stability also when coated with sodium perborate, sodium silicate and other coating agents in combination. Particularly, when sodium perborate and sodium silicate are used in combination with an organic high-molecular compound such as PEG or a sequestering agent such as EDTA or NTA, a synergistic effect can be obtained and the storage stability is further improved.

EXAMPLE 13

20 kg of wet sodium percarbonate was charged in a centrifugal diffusion type mixer (Lödige Mixer, FKM-130D, T.M. Engineering Co., Ltd.). A powdered coating agent was added thereto with stirring. Mixing was conducted for 10 minutes in total. Then the coated sodium percarbonate was taken out and dried with hot air. The following coating agents were used.

1 5% sodium metaborate ($NaBO_2.4H_2O$)+1% (on a solid basis) sodium silicate (JIS No. 3)+0.5% EDTA.2TEA,
2 4.54% borax ($Na_2B_4O_7.10H_2O$)+1% (on a solid basis) sodium silicate (JIS No. 3)+0.5% EDTA.2TEA and
3 2.4% boric acid ($H_3BO_3$)+1% (on a solid basis) sodium silicate (JIS No. 3)+0.5% EDTA.2TEA.

Note: The percentage is wt.% based on sodium percarbonate.

10 g of each of four samples [i.e., the above three coated sodium percarbonates (two samples of the present invention and one sample of comparative example) and uncoated sodium percarbonate] was incorporated in a phosphorus-free bleaching detergent composition having a composition given below as in Examples 9 and 10. A storage stability test was conducted in a similar manner to that described in Example 9. The results are given in Table 12. Further, the residual activity of an enzyme (alcalase 2.0M) simultaneously incorporated in the composition was also measured.

| Phosphorus-free bleaching detergent composition | wt. % |
|---|---|
| sodium dodecylbenzenesulfonate | 20.0 |
| synthetic zeolite (type 4A) | 20.0 |
| sodium silicate (JIS No. 2) | 10.0 |
| sodium carbonate | 5.0 |
| fluorescent dye | 0.5 |
| sodium salt of carboxymethylcellulose | 1.0 |
| enzyme (alcalase 2.0 M) | 0.3 |
| sodium percarbonate (coated) | 10.0 |
| water | 5.0 |
| sodium sulfate | balance |
| Total | 100 |

TABLE 12

| | Coating of sodium percarbonate* | | | | | Available oxygen residue (%) | Enzymatic activity residue (%) |
|---|---|---|---|---|---|---|---|
| 1 | $NaBO_2.4H_2O$ 5% | + | sodium silicate** 1% | + | EDTA.2TEA 0.5% | 93.9 | 96.8 |

TABLE 12-continued

| | Coating of sodium percarbonate* | | | | | Available oxygen residue (%) | Enzymatic activity residue (%) |
|---|---|---|---|---|---|---|---|
| 2 | $Na_2B_2O_7.10H_2O$ 4.54% | + | sodium silicate 1% | + | EDTA.2TEA 0.5% | 89.0 | 94.6 |
| 3 | $H_3BO_3$ 2.4% | + | sodium silicate 1% | + | EDTA.2TEA 0.5% | 75.0 | 90.4 |
| 4 | | | none | | | 32.0 | 80.3 |

*The coating rate on a water-free basis was 3.9% in all cases.
**sodium silicate (JIS No. 3)

It is apparent from Table 12 that sodium percarbonate exhibits very good stability and the enzyme also has an excellent stability, though the bleaching detergents 1 and 2 of the present invention contain zeolite blended therewith.

EXAMPLE 14

10 wt.% of each of the coated sodium percarbonates (coated with $NaBO_2.4H_2O$ and $Na_2B_4O_7.10H_2O$ in combination with sodium silicate) of the present invention prepared in Example 13 and two comparative samples (one coated with $H_3BO_3$ in combination with sodium silicate and prepared in Example 5 and uncoated sodium percarbonate) was incorporated in a powdered bleaching detergent having a composition given below. A storage stability test was conducted in a similar manner to that described in Examples 9 and 13. The test results on the available oxygen residue of sodium percarbonate and enzymatic activity residue of alcalase 2.0M are given in Table 13.

| Bleaching detergent composition | wt. % |
|---|---|
| sodium dodecylbenzenesulfonate | 20.0 |
| sodium tripolyphosphate | 18.0 |
| sodium silicate (JIS No. 2) | 10.0 |
| sodium carbonate | 5.0 |
| fluorescent dye | 0.5 |
| sodium salt of carboxymethylcellulose | 0.5 |
| enzyme (alcalase 2.0 M) | 0.3 |
| sodium percarbonate | 10.0 |
| water | 5.0 |
| sodium sulfate | balance |
| Total | 100 |

TABLE 13

| | Coating of sodium percarbonate* | | | | | Available oxygen residue (%) | Enzymatic activity residue (%) |
|---|---|---|---|---|---|---|---|
| 1 | $NaBO_2.4H_2O$ 5% | + | sodium silicate 1% | + | EDTA.2TEA 0.5% | 97.0 | 84.8 |
| 2 | $Na_2B_2O_7.10H_2O$ 4.54% | + | sodium silicate 1% | + | EDTA.2TEA 0.5% | 96.0 | 86.0 |
| 3 | $H_3BO_3$ 2.4% | + | sodium silicate 1% | + | EDTA.2TEA 0.5% | 90.8 | 81.0 |
| 4 | | | none | | | 88.8 | 60.5 |

*The coating rate on a water-free basis was 3.9%.

This example shows the use of a conventional bleaching detergent composition containing STPP. Here also, the composition of the present invention exhibits a very excellent storage stability. This fact shows that the bleaching detergent of the present invention has a very excellent storage stability, irrespective of whether zeolite is present or not.

EXAMPLE 15

100 g of sodium percarbonate was charged in an agitating mixer. A 25% aqueous solution of 5 g of sodium metaborate tetrahydrate ($NaBO_2.4H_2O$) (prepared by dissolving the metaborate in water with heating) and a 25% aqueous solution of 1 g of anhydrous magnesium sulfate ($MgSO_4$) were sprayed thereon with stirring at 250 r.p.m. After stirring for 10 min, sodium percarbonate was dried with hot air to obtain coated sodium percarbonate.

For the purpose of comparison, sodium percarbonate coated with only sodium metaborate (7.1 g of $NaBO_2.4H_2O$ per 100 g of sodium percarbonate), one coated with boric acid (3.4 g of boric acid per 100 g of sodium percarbonate), one coated with boric acid and anhydrous magnesium sulfate (2.4 g of boric acid and 1 g of $MgSO_4$ per 100 g of sodium percarbonate), and one coated with only anhydrous magnesium sulfate (3.4 g of $MgSO_4$ per 100 g of sodium percarbonate) were also prepared.

10 wt.% of each of these coated sodium percarbonates was uniformly incorporated in a powdered phosphorus-free detergent having the following composition to obtain a bleaching detergent:

| phosphorus-free bleaching detergent composition | wt. % |
|---|---|
| sodium dodecylbenzenesulfonate | 20.0 |
| synthetic zeolite (4A type) | 20.0 |
| sodium silicate (JIS No. 2) | 10.0 |
| sodium carbonate | 5.0 |
| fluorescent dye | 0.5 |
| sodium salt of carboxymethylcellulose | 1.0 |
| enzyme (alcalase) | 0.3 |
| sodium percarbonate | 10.0 |
| water | 5.0 |
| sodium sulfate | balance |
| Total | 100 |

Six samples of compositions containing, as sodium percarbonate to be incorporated in the above composition, one coated with sodium metaborate and $MgSO_4$ according to the present invention, one coated with only sodium metaborate, one coated with boric acid, one coated with boric acid and $MgSO_4$, one coated with only $MgSO_4$ and uncoated sodium percarbonate, were subjected to a storage stability test. The results are given in Table 14,

TABLE 14

| | Coating of sodium percarbonate* | | Available oxygen residue (%) |
|---|---|---|---|
| Bleaching detergent of the present invention | 5%<br>1% | sodium metaborate ($NaBO_2.4H_2O$)<br>$MgSO_4$ | 86.2 |
| Comparative Example 8 | 7.1% | sodium metaborate ($NaBO_2.4H_2O$) | 79.7 |
| Comparative Example 9 | 3.4% | boric acid ($H_3BO_3$) | 60.8 |
| Comparative Example 10 | 2.4%<br>1% | boric acid ($H_3BO_3$)<br>$MgSO_4$ | 65.0 |
| Comparative Example 11 | 3.4% | $MgSO_4$ | 50.8 |
| Comparative Example 12 | | none | 31.1 |

*The ratio (coating ratio) of coating agent to sodium percarbonate was 3.4% on a water-free solid basis in all cases.

It is apparent that the available oxygen residue of the bleaching detergent containing sodium percarbonate coated with sodium metaborate and $MgSO_4$ according to the present invention is higher than those of Comparative Examples 8 and 12, and the bleaching agent of the present invention is superior in the coating effect to those of Comparative Examples 8 to 12.

The bleaching detergent used in this example does not contain phosphorus at all and is a phosphorus-free detergent containing zeolite blended therewith. The bleaching detergent according to the present invention exhibits a good stability because of an excellent coating-stabilizing effect due to sodium metaborate and $MgSO_4$.

EXAMPLE 16

Sodium percarbonate was coated by the procedure of Example 15 using various magnesium compounds in combination with sodium metaborate. The following coating agents were used:

1 5% $NaBO_2.4H_2O$+1% (on a water-free solid basis) $MgSO_4$,
2 5% $NaBO_2.4H_2O$+1% (on a water-free solid basis) $MgCl_2$,
3 5% $NaBO_2.4H_2O$+1% (on a water-free solid basis) $2MgO.3SiO_2$,
4 5% $NaBO_2.4H_2O$+1% (on a water-free solid basis) MgO and
5 7.1% $NaBO_2.4H_2O$ 10 wt.% of each of six samples (i.e., the above five coated sodium percarbonate and uncoated sodium percarbonate) was incorporated in the phosphorus-free bleaching detergent having the same composition as that of Example 15. A storage stability test was conducted in a similar manner to that described in Example 15. The results are given in Table 15.

TABLE 15

| | Coating of sodium percarbonate* | Available oxygen residue, % |
|---|---|---|
| 1 | 5% $NaBO_2.4H_2O$ + 1% $MgSO_4$ | 85.8 |
| 2 | 5% $NaBO_2.4H_2O$ + 1% $MgCl_2$ | 83.9 |
| 3 | 5% $NaBO_2.4H_2O$ + 1% $2MgO.3SiO_2$ | 84.0 |
| 4 | 5% $NaBO_2.4H_2O$ + 1% MgO | 82.1 |
| 5 | 7.1% $NaBO_2.4H_2O$ | 79.7 |
| 6 | none | 31.1 |

*The coating ratio was 3.4% (on a water-free basis) based on sodium percarbonate in all cases.

It is apparent that compositions 1 to 4 of the present invention exhibit a very excellent storage stability by the synergistic effect of the coating power of the borate and the stabilizing power of the magnesium compound.

EXAMPLE 17

Sodium carbonate was coated by the procedure of Example 15 with the exception that sodium metaborate and magnesium sulfate were ued in combination with other coating agents shown below. The amounts of the coating agents were wt.% based on sodium percarbonate.

1 5% $NaBO_2.4H_2O$+1% (on a water-free solid basis) $MgSO_4$+5% polyethylene glycol (PEG, molecular weight=6000),
2 5% $NaBO_2.4H_2O$+1% (on a water-free solid basis) $MgSO_4$+5% sodium carbonate,
3 5% $NaBO_2.4H_2O$+1% (on a water-free solid basis) $MgSO_4$+0.5% disodium ethylene-diaminetetraacetate (EDTA.2Na),
4 5% $NaBO_2.4H_2O$+1% (on a water-free solid basis) $MgSO_4$+0.5% EDTA.di(triethanolamine) salt (2TEA) and
5 5% $NaBO_2.4H_2O$+1% (on a water-free solid basis) $MgSO_4$+0.5% trisodium nitrilotriacetate (NTA.3Na).

10 wt.% of each of six samples (i.e., the above five coated sodium percarbonate and uncoated sodium percarbonate) was incorporated in the phosphorus-free bleaching detergent having the same composition as that of Example 15. A storage stability test was conducted in a similar manner to that described in Example 15. The results are given in Table 16.

TABLE 16

| | Coating of sodium percarbonate | Available oxygen residue, % |
|---|---|---|
| 1 | $NaBO_2.4H_2O$ + $MgSO_4$ + PEG<br>5% 1% 5% | 88.0 |
| 2 | $NaBO_2.4H_2O$ + $MgSO_4$ + $Na_2CO_3$<br>5% 1% 5% | 86.0 |
| 3 | $NaBO_2.4H_2O$ + $MgSO_4$ + EDTA.2Na<br>5% 1% 0.5% | 86.0 |
| 4 | $NaBO_2.4H_2O$ + $MgSO_4$ + EDTA.2TEA<br>5% 1% 0.5% | 91.8 |
| 5 | $NaBO_2.4H_2O$ + $MgSO_4$ + NTA.3Na<br>5% 1% 0.5% | 90.6 |
| 6 | none | 30.5 |

It is apparent that sodium percarbonate exhibit a very excellent storage stability also when coated with sodium metaborate, magnesium sulfate and other coating agents in combination. Particularly, when sodium metaborate and $MgSO_4$ are used in combination with an organic high-molecular compound such as PEG or a sequestering agent such as EDTA or NTA, the storage stability is further improved by the synergistic effect.

EXAMPLE 18

The solubility, compression strength and disintegrating property of the coated sodium percarbonates prepared in Example 17 were examined. The results are given in Table 17.

TABLE 17

| | Coating of sodium percarbonate | Solubility (sec) | Compression strength ($kg/cm^2$) | Disintegrating property (%) |
|---|---|---|---|---|
| 1 | $NaBO_2.4H_2O$ 5% + $MgSO_4$ 1% + PEG 5% | 94 | 18.9 | 15.0 |
| 2 | $NaBO_2.4H_2O$ 5% + $MgSO_4$ 1% + $Na_2CO_3$ 5% | 93 | 19.6 | 14.7 |
| 3 | $NaBO_2.4H_2O$ 5% + $MgSO_4$ 1% + EDTA.2Na 0.5% | 91 | 19.2 | 14.6 |
| 4 | $NaBO_2.4H_2O$ 5% + $MgSO_4$ 1% + EDTA.2TEA 0.5% | 90 | 21.3 | 13.3 |
| 5 | $NaBO_2.4H_2O$ 5% + $MgSO_4$ 1% + NTA.3Na 0.5% | 95 | 22.1 | 13.3 |
| 6 | none | 90 | 20.6 | 13.4 |

It is apparent from Table 17 that the solubility, compression strength and disintegrating property of sodium percarbonate coated according to the process of the present invention are nearly equal to those of uncoated sodium percarbonate.

EXAMPLE 19

20 kg of wet sodium percarbonate was charged in a centrifugal diffusion type mixer (Lödige Mixer, FKM-130D, T.M. Engineering Co., Ltd.). A powdered coating agent was added thereto with stirring. Mixing was conducted for 10 minutes in total. Then the coated sodium percarbonate was taken out and dried with hot air. The following coating agents were used:

1 5% sodium metaborate ($NaBO_2.4H_2O$)+1% (on a water-free solid basis) $MgSO_4$+0.5% EDTA.2TEA,
2 4.54% borax ($Na_2B_4O_7.10H_2O$)+1% (on a water-free solid basis) $MgSO_4$+0.5% EDTA.2TEA and
3 2.4% boric acid ($H_3BO_3$)+1% (on a water-free solid basis) $MgSO_4$+0.5% EDTA.2TEA Note: The percentage is wt.% based on sodium percarbonate.

10 wt.% of each of four samples [i.e., the above three coated sodium percarbonates (two samples of the present invention and one sample of comparative example) and uncoated sodium percarbonate] was incorporated in a phosphorus-free bleaching detergent composition having a composition given below as in Examples 15 and 16. A storage stability test was conducted in a similar manner to that described in Example 15. The results are given in Table 18. Further, the residual activity of an enzyme (alcalase 2.0M) simultaneously incorporated in the composition was also measured.

| phosphorus-free bleaching detergent composition | wt. % |
|---|---|
| sodium dodecylbenzenesulfonate | 20.0 |
| synthetic zeolite (type 4A) | 20.0 |
| sodium silicate (JIS No. 2) | 10.0 |
| sodium carbonate | 5.0 |
| fluorescent dye | 0.5 |
| sodium salt of carboxymethylcellulose | 1.0 |

-continued

| phosphorus-free bleaching detergent composition | wt. % |
|---|---|
| enzyme (alcalase 2.0 M) | 0.3 |
| sodium percarbonate (coated) | 10.0 |
| water | 5.0 |
| sodium sulfate | balance |
| Total | 100 |

TABLE 18

| | Coating of sodium percarbonate* | Available oxygen residue (%) | Enzymatic activity residue (%) |
|---|---|---|---|
| 1 | $NaBO_2.4H_2O$ 5% + $MgSO_4$ 1% + EDTA.2TEA 0.5% | 92.8 | 96.0 |
| 2 | $Na_2B_4O_7.10H_2O$ 4.54% + $MgSO_4$ 1% + EDTA.2TEA 0.5% | 89.8 | 96.0 |
| 3 | $H_3BO_3$ 2.4% + $MgSO_4$ 1% + EDTA.2TEA 0.5% | 74.0 | 90.0 |
| 4 | none | 32.0 | 81.0 |

*The coating ratio on a water-free solid basis was 3.9% based on sodium percarbonate in all cases.

It is apparent from Table 18 that in the phosphorus-free bleaching detergents 1 and 2 of the present invention, sodium percarbonate exhibits a very good stability and the enzyme also has an excellent stability, though zeolite is incorporated therein.

EXAMPLE 20

10 wt.% of each of the coated sodium percarbonate (coated with $NaBO_2.4H_2O$ and $Na_2B_4O_7.10H_2O$ in combination with $MgSO_4$) of the present invention prepared in Example 5 and two comparative samples (one coated with $H_3BO_3/MgSO_4$ prepared in Example 5 and uncoated sodium percarbonate) was incorporated in a powdered bleaching detergent having a composition given below. A storage stability test was conducted in a similar manner to that described in Examples 15 to 19. The test results on the available oxygen residue of sodium percarbonate and the enzymatic activity residue of alcalase 2.0M are given in Table 19.

| Bleaching detergent composition | wt. % |
|---|---|
| sodium dodecylbenzenesulfonate | 20.0 |
| sodium tripolyphosphate | 18.0 |
| sodium silicate (JIS No. 2) | 10.0 |
| sodium carbonate | 5.0 |
| fluorescent dye | 0.5 |
| sodium salt of carboxymethylcellulose | 0.5 |
| enzyme (alcalase 2.0 M) | 0.3 |
| sodium percarbonate | 10.0 |
| water | 5.0 |
| sodium sulfate | balance |

-continued

| Bleaching detergent composition | wt. % |
|---|---|
| Total | 100 |

TABLE 19

| | Coating of sodium percarbonate* | Available oxygen residue (%) | Enzymatic activity residue (%) |
|---|---|---|---|
| 1 | $NaBO_2.4H_2O$ 5% + $MgSO_4$ 1% + EDTA.2TEA 0.5% | 96.8 | 86.1 |
| 2 | $Na_2B_4O_7.10H_2O$ 4.54% + $MgSO_4$ 1% + EDTA.2TEA 0.5% | 97.8 | 87.2 |
| 3 | $H_3BO_3$ 2.4% + $MgSO_4$ 1% + EDTA.2TEA 0.5% | 90.7 | 80.5 |
| 4 | none | 88.8 | 60.5 |

*The coating, ratio on a water-free solid basis was 3.9%.

This example shows the use of a conventional bleaching detergent composition containing STPP. Here also, the composition of the present invention exhibits a very excellent storage ability. This fact shows that the bleaching detergent of the present invention has a very excellent storage stability, irrespective of whether zeolite is present or not.

EXAMPLE 21

100 g of sodium percarbonate was charged in an agitating mixer. A 25% aqueous solution of 5 g of sodium metaborate tetrahydrate ($NaBO_2.4H_2O$) (prepared by dissolving the metaborate in water with heating) was sprayed thereon with stirring at 250 r.p.m. After stirring for 10 min, sodium percarbonate was dried with hot air to obtain coated sodium percarbonate.

For the purpose of comparison, sodium percarbonate coated with boric acid (2.4 g of boric acid per 100 g of sodium percarbonate) was prepared.

Each of these coated percarbonates (one coated with sodium metaborate according to the present invention and the other coated with boric acid for the purpose of comparison) and uncoated sodium percarbonate was uniformly incorporated in a bleaching agent composition (1) having the following composition. These three samples of the bleaching agent compositions were subjected to a storage stability test. At the same time, their smells were examined.

| Bleaching agent composition (1) | wt. % |
|---|---|
| sodium percarbonate | 30 |
| sodium pyrophosphate | 10 |
| sodium lauryl sulfate | 5 |
| Glauber's salt | 15 |
| granular activating agent A* | 40 |
| Total | 100 |

*This agent was prepared by granulating 50 wt. % of glucose pentaacetate, 10 wt. % of polyethylene glycol having an average molecular weight of 6000 and 40 wt. % of sodium sulfate in a granulator (X-Pelleter 60-D, manufactured by Fuji Powdaru K.K.) under pressure while passing through a screen of 0.77 mmϕ.

TABLE 20

| | Coating of sodium percarbonate | Available oxygen residue (%) | Smell |
|---|---|---|---|
| Bleaching agent of the present invention | *5% sodium metaborate ($NaBO_2.4H_2O$) | 79 | good |
| Comparative Example 1 | 2.4% boric acid ($H_3BO_3$) | 61 | slightly bad smell |
| Comparative Example 2 | none | 40 | smell of acetic acid |

*The amount (on a water-free solid basis) of the coating was 2.4% based on sodium percarbonate.

It is apparent from Table 20 that the bleaching agent composition of the present invention is much superior in storage stability to those of Comparative Examples (boric acid-coated sodium percarbonate and uncoated sodium percarbonate). The product of the present invention has no problem with smell.

EXAMPLE 22

Each of three samples (sodium percarbonate coated with sodium metaborate according the present invention, sodium percarbonate coated with boric acid for the purpose of comparison, and uncoated sodium percarbonate) used in Example 21 was uniformly incorporated in a bleaching agent composition (2) having a different composition from that of Example 21. These samples were subjected to the same storage stability test as that of Example 21. The results are given in Table 21.

| Bleaching agent composition (2) | wt. % |
|---|---|
| sodium percarbonate | 40 |
| sodium tripolyphosphate | 10 |
| fluorescent dye | 0.3 |
| perfume | 0.3 |
| Glauber's salt | balance |
| granular activating agent B* | 40 |
| Total | 100 |

*This agent was prepared by granulating 5 wt. % of $CuSO_4.5H_2O$, 5 wt. % of picolinic acid, 20 wt. % of polyethylene glycol having an average molecular weight of 6000 and 70 wt. % of sodium sulfate in a granulator (X-pelleter 60-D, manufactured by Fuji Powdaru K.K.) under pressure while passing through a screen of 0.7 mmϕ.

TABLE 21

| | Coating of sodium percarbonate | Available oxygen residue (%) |
|---|---|---|
| Bleaching agent of the present invention | *5% sodium metaborate ($NaBO_2.4H_2O$) | 66 |
| Comparative Example 1 | 2.4% boric acid ($H_3BO_3$) | 25 |
| Comparative Example 2 | none | 3 |

*The amount (on a water-free solid basis) of the coating was 2.4% based on sodium percarbonate.

It is apparent from Table 21 that the bleaching agent composition of the present invention has also an excellent storage stability in the example where a transition-metal activating agent was blended.

EXAMPLE 23

Sodium percarbonate was coated with sodium metaborate in combination with another coating agent in a similar manner to that described in Example 21. The following combinations of sodium percarbonate with other coating agents were used. The amounts of other coating agents are in wt.% based on the amount of sodium percarbonate.

1 5% sodium metaborate ($NaBO_4.4H_2O$)+5% polyethylene glycol (PEG, molecular weight=6000),
2 5% sodium metaborate+5% sodium carbonate,
3 5% sodium metaborate+0.5% disodium ethylenediaminetetraacetate (EDTA),
4 5% sodium metaborate+0.5% EDTA.di(triethanolamine) salt, and
5 5% sodium metaborate+0.5% trisodium nitrilotriacetate (NTA).

Each of six samples (i.e., the above-mentioned five samples of the coated sodium percarbonate and uncoated sodium percarbonate) was uniformly incorporated in each of bleaching agent compositions having the following compositions (3-1) and (3-2). These compositions were subjected to the same storage stability test as that described in Example 21. The results are given in Table 22.

| | Bleaching agent composition (3-1) | Bleaching agent composition (3-2) |
|---|---|---|
| sodium percarbonate | 40 | 30 |
| sodium tripolyphosphate | 10 | — |
| sodium pyrophosphate | — | 10 |
| sodium silicate | — | 2 |
| fluorescent dye | 0.3 | 0.3 |
| perfume | 0.3 | 0.3 |
| Glauber's salt | balance | balance |
| granular activating agent C* | 40 | — |
| granular activating agent D* | — | 40 |
| Total | 100 | 100 wt. % |

*These agents were prepared in the following manner. Mixtures composed of the following composition C and D were heated at about 140° C. and stirred until a uniform paste was formed. The paste was cooled to room temperature to solidify it. The solid was crushed and granules having a particle size of 250 to 1000μ were employed.

| | C | D |
|---|---|---|
| sucrose octaacetate | 70 | — |
| $FeSO_4.5H_2O$ | — | 5 |
| $CoSO_4.7H_2O$ | — | 1 |
| sodium iminodiacetate | — | 5 |
| polyethylene glycol (average molecular weight = 6000) | 10 | 60 |
| corn starch | 10 | 10 |
| Glauber's salt | 10 | 19 |

TABLE 22

| | Coating of sodium percarbonate | Available oxygen residue in composition 3-1 (%) | Available oxygen residue in composition 3-2 (%) |
|---|---|---|---|
| 1 | $NaBO_2.4H_2O$ 5% + PEG 5% | 84 | 70 |
| 2 | $NaBO_2.4H_2O$ 5% + $NaCO_3$ 5% | 80 | 69 |
| 3 | $NaBO_2.4H_2O$ 5% + EDTA.2Na 0.5% | 79 | 69 |
| 4 | $NaBO_2.4H_2O$ 5% + EDTA.2TEA 0.5% | 89 | 72 |
| 5 | $NaBO_2.4H_2O$ 5% + NTA.3Na 0.5% | 86 | 71 |
| 6 | not coated | 42 | 5 |

It is apparent from Table 22 that the compositions of the present invention have also an excellent storage stability even when sodium percarbonate is used in combination with other coating agents. Particularly, when sodium metaborate is used in combination with an organic high-molecular compound such as PEG or a sequestering agent such as EDTA or NTA, a synergistic effect can be obtained and the storage stability is further improved.

EXAMPLE 24

20 kg of wet sodium percarbonate was charged in a centrifugal diffusion type mixer (Lödige Mixer, FKM-130D, manufactured by T.M. Engineering Co., Ltd.). A powdered coating agent was added thereto with stirring. Mixing was conducted for 10 min in total. Then the coated sodium percarbonate was taken out and dried with hot air. The following coating agents were used.

1 5% sodium metaborate ($NaBO_2.4H_2O$)+0.5% EDTA.2TEA,
2 4.54% borax ($Na_2B_4O_7.10H_2O$)+0.5% EDTA.2TEA and
3 2.4% boric acid ($H_3BO_3$)+0.5% EDTA.2TEA (the percentages are given by weight based on sodium percarbonate).

Each of four samples (i.e., three samples of two coated sodium percarbonate according to the present invention and one coated sodium percarbonate of comparative example, and uncoated sodium percarbonate) was uniformly incorporated in each of bleaching agent compositions having the following compositions (4-1) and (4-2). These compositions were subjected to the same storage stability test as that described in Example 21. The results are given in Table 23.

| | Bleaching agent composition (4-1) | Bleaching agent composition (4-2) |
|---|---|---|
| sodium percarbonate | 30 | 40 |
| sodium carbonate (anhydrous) | — | 10 |
| sodium silicate | 2 | 2 |
| fluorescent dye | 0.3 | 0.3 |
| perfume | 0.3 | 0.3 |
| carboxymethylcellulose | 2 | 2 |
| Glauber's salt | balance | balance |
| granular activating agent E* | 40 | — |
| granular activating agent F* | — | 40 |
| Total | 100 | 100 wt. % |

*These agents were prepared in the following manner. Acetone was added to mixtures having the following compositions E and F. They were thoroughly kneaded in a mortar and acetone was removed therefrom under reduced pressure. After drying, the residue was crushed to coarse grain. Granules having a particle size of 250 to 1000μ were employed.

| | E | F |
|---|---|---|
| tetraacetylethylenediamine | 70 | — |
| tetraacetylglycollyl | — | 70 |
| polyethylene glycol (average molecular weight = 6000) | 10 | 10 |
| hydroxypropyl starch | 10 | 10 |
| magnesium silicate | 5 | 5 |
| Glauber's salt | 5 | 5 |

TABLE 23

| | Coating of sodium percarbonate | | Available oxygen residue in composition 4-1 (%) | Available oxygen residue in composition 4-2 (%) |
|---|---|---|---|---|
| 1 | $NaBO_2.4H_2O$ 5%* | + EDTA.2TEA 0.5% | 92 | 90 |
| 2 | $Na_2B_4O_7.10H_2O$ 4.54%* | + EDTA.2TEA 0.5% | 88 | 91 |
| 3 | $H_3BO_3$ 2.4% | + EDTA.2TEA 0.5% | 54 | 60 |
| 4 | not coated | | 40 | 41 |

*The amount (on a water-free solid basis) of the coating was 2.4%.

In this experiment, the coating of sodium percarbonate was carried out in a larger-scale than in Examples 21 to 23. It is apparent from Table 23 that the coated products (1) and (2) of the present invention are superior in the storage stability of sodium percarbonate to the comparative products (3) and (4).

EXAMPLE 25

The coated sodium percarbonate obtained in Example 24 was added to each of two enzyme-containing bleaching compositions given below. The resulting compositions were each examined in respect to the storage stability after they had been stored at 50° C. for 20 days. Results are shown in Table 24.

| | composition (1) | composition (2) |
|---|---|---|
| coated sodium percarbonate | 80 wt. % | 80 wt. % |
| sodium carbonate | 10 | 10 |
| alcalase 2.0 M as enzyme | 2 | 2 |
| zeolite of 4A type | — | 5 |
| sodium sulfate | 8 | 3 |
| total amount | 100 | 100 |

This example does not contain a surfactant and Nos. 1 and 2 among them fall within the scope of the invention, but Nos. 3 and 4 do not. It is understood from the results that Nos. 1 and 2 were superior to the controls 3 and 4 with respect to the storage stability of the sodium percarbonate and the enzyme. Moreover the stability of the enzyme was improved in the composition (2), containing the zeolite, than in the composition (1).

TABLE 24

| | Coating of sodium percarbonate | | composition (1) | | composition (2) | |
|---|---|---|---|---|---|---|
| | | | available oxygen residue % | enzymatic activity residue % | available oxygen residue % | enzymatic activity residue % |
| 1 | $NaBO_2.4H_2O$ 5%* | + EDTA.2TEA 0.5% | 94.8 | 72.2 | 94.2 | 90.3 |
| 2 | $Na_2B_4O_7.10H_2O$ 4.54%* | + EDTA.2TEA 0.5% | 93.8 | 68.7 | 93.7 | 89.2 |
| 3 | $H_3BO_3$ 2.4% | + EDTA.2TEA 0.5% | 91.2 | 42.2 | 80.1 | 80.6 |
| 4 | not coated | | 90.2 | 28.3 | 51.6 | 60.4 |

*The amount (on a water-free solid basis) of the coating was 2.4%.

The embodiments of the invention in which an exclusive property or privilege is claimed are defined as follows:

1. A bleaching detergent composition, which comprises: from 1 to 99% by weight of coated sodium percarbonate particles having an average particle diameter of from 100 to 2000 microns, each of said particles comprising a core consisting essentially of sodium percarbonate completely enclosed by a coating film of a coating agent containing from 10 to 100% by weight, based on said coating agent, of a borate selected from the group consisting of sodium tetraborate decahydrate, sodium tetraborate pentahydrate, sodium tetraborate tetrahydrate, anhydrous sodium tetraborate, sodium octaborate tetrahydrate, sodium pentaborate pentahydrate, sodium metaborate tetrahydrate and sodium metaborate dihydrate, said coated sodium percarbonate particles being blended with a detergent base.

2. A composition as claimed in claim 1 in which said coated sodium percarbonat particles are contained in an amount of 1 to 40 percent by weight.

3. A composition as claimed in claim 1 in which said coated sodium percarbonate particles are contained in an amount of 40 to 99 percent by weight.

4. A composition as claimed in claim 1, in which said borate is sodium metaborate tetrahydrate or sodium metaborate dihydrate.

5. A composition as claimed in claim 1, in which the amount of said coating agent is 0.1 to 30 percent by weight of the weight of said sodium percarbonate.

6. A composition as claimed in claim 1, in which said coating agent further contains a sequestering agent.

7. A composition as claimed in claim 1, in which said coating agent contains ethylenediamine tetraacetate or nitrilotriacetate as a sequestering agent.

8. A composition as claimed in claim 1, in which said coating agent further contains an alkali metal silicate or a magnesium compound.

9. A composition as claimed in claim 3, which further contains an enzyme and a synthetic zeolite.

10. A composition as claimed in claim 1, wherein said coating agent consists of said borate.

11. A composition as claimed in claim 1, wherein said coating agent consists essentially of said borate and at least one additive selected from the group consisting of a sequestering agent, a magnesium compound, and an alkali metal silicate.

12. A composition as claimed in claim 1, wherein said coating agent further comprises at least one additive selected from the group consisting of sodium carbonate, Glauber's salt, magnesium sulfate, polyethylene glycol, polyvinyl pyrrolidone, hydroxypropyl cellulose, nitrilotriacetate, and ethylenediamine tetraacetate.

13. A composition as claimed in claim 1, wherein said coating agent contains a sodium silicate of the formula $Na_2O.nSiO_2$, wherein n is in the range of 0.5 to 4.

14. A composition as claimed in claim 1, wherein said coating agent contains from 5 to 70 wt.% of a magnesium compound selected from the group consisting of magnesium sulfate, magnesium chloride, magnesium oxide, magnesium hydroxide, magnesium silicate, magnesium nitrate, magnesium phosphate, and magnesium carbonate, in anhydrous or hydrated form, and magnesium salts of organic acids.

15. A composition as claimed in claim 1, wherein said detergent base comprises at least one member selected from the group consisting of zeolite, sodium metasilicate, acid sodium pyrophosphate, sodium tripolyphosphate, sodium dodecabenzene sulfonate, and sodium sulfate.

16. A bleaching detergent composition which comprises: (A) 1 to 99 wt.% of coated sodium percarbonate particles having an average particle of from 100 to 2000 microns, each of said particles comprising a sodium percarbonate core completely enclosed by a coating film of a coating agent consisting essentially of 10 to 100 wt.% of a sodium borate selected from the group consisting of sodium metaborates, sodium tetraborates, sodium pentaborates, and sodium octaborates, the amount of said coating film being in the range of from 0.1 to 30 wt.% of the weight of said sodium percarbonate; and (B) a detergent base consisting essentially of at least one member selected from the group consisting of water-soluble soaps, anionic, nonionic or amphoteric surfactants, builders, sequestering agents, bulk fillers, detergent enzymes, bleach activating agents, fluorescent brightening agents and perfumes.

17. A composition as claimed in claim 16, wherein said coating film consists essentially of sodium metaborate, $MgSO_4$, and at least one member selected from polyethylene glycol, ethylenediamine tetraacetate, and nitrilotriacetate.

18. A process for preparing a bleaching detergent composition which consists essentially of forming granules of sodium percarbonate which are wetted with water; mixing said wetted granules with a coating agent powder consisting essentially of 10 to 100 wt.% of a sodium borate selected from the group consisting of sodium tetraborate decahydrate, sodium tetraborate pentahydrate, sodium tetraborate tetrahydrate, anhydrous sodium tetraborate, sodium octaborate tetrahydrate, sodium pentaborate pentahydrate, sodium metaborate tetrahydrate, and sodium metaborate dihydrate, whereby said powder adheres to the surfaces of said granules, then drying said granules at a temperature sufficient to melt said borate and not higher than 160° C., whereby said granules are individually coated with a coating film of said borate, and then mixing said coated granules with a detergent base, the amount of said coated granules being 1 to 99 wt.% of the total weight of said bleaching detergent composition.

19. A process as claimed in claim 18, wherein said drying temperature is in the range of 40° to 160° C.

20. A process as claimed in claim 19, wherein said wetted granules of sodium percarbonate have a moisture content in the range of from 10 to 16%.

21. A bleaching detergent composition which is prepared by the process claimed in claim 18.

* * * * *